US010286438B2

(12) United States Patent
Kohno

(10) Patent No.: US 10,286,438 B2
(45) Date of Patent: May 14, 2019

(54) DIE CUSHION-CUM-SLIDE CUSHION DEVICE AND METHOD OF CONTROLLING THE SAME

(71) Applicant: AIDA ENGINEERING, LTD., Kanagawa (JP)

(72) Inventor: Yasuyuki Kohno, Kanagawa (JP)

(73) Assignee: AIDA Engineering, Ltd., Kanagawa (JP)

( * ) Notice: Subject to any disclaimer, the term of this patent is extended or adjusted under 35 U.S.C. 154(b) by 490 days.

(21) Appl. No.: 15/202,913

(22) Filed: Jul. 6, 2016

(65) Prior Publication Data

US 2017/0008061 A1 Jan. 12, 2017

(30) Foreign Application Priority Data

Jul. 10, 2015 (JP) ..... 2015-138928

(51) Int. Cl.
*B21D 24/02* (2006.01)
*B21D 24/12* (2006.01)
(Continued)

(52) U.S. Cl.
CPC ..... *B21D 24/02* (2013.01); *B21D 24/12* (2013.01); *B21D 24/14* (2013.01); *B30B 15/061* (2013.01)

(58) Field of Classification Search
CPC ..... B21D 24/02; B30B 15/16; B30B 15/161; B30B 15/165; B30B 15/166; B30B 15/18;
(Continued)

(56) References Cited

U.S. PATENT DOCUMENTS 3,202,411 A * 8/1965 Heiser ..... B21D 24/02 267/119
5,794,482 A * 8/1998 Walkin ..... B21D 24/14 72/350
(Continued)

FOREIGN PATENT DOCUMENTS

DE 3835470 A1 * 6/1989 ..... B21D 24/02
EP 1777018 A2 4/2007
(Continued)

OTHER PUBLICATIONS

Machine Translation of DE 3835470, Translated Dec. 20, 2018, 2 Pages. (Year: 1989).*
(Continued)

*Primary Examiner* — Teresa M Ekiert
*Assistant Examiner* — Gregory D Swiatocha
(74) *Attorney, Agent, or Firm* — McDermott Will & Emery LLP

(57) ABSTRACT

A die cushion-cum-slide cushion device selectively opens and closes a flow channel between a hydraulic pump/motor driven by a servo motor, and hydraulic cylinders that generate slide cushion force, or a flow channel between the hydraulic pump/motor, and hydraulic cylinders that generate die cushion force, by switching a selector valve. Before applying the slide cushion force is started, the servo motor is controlled to allow the hydraulic cylinders to generate required slide cushion force through a check valve. While the slide cushion force is applied, hydraulic circuits, each of which includes a logic valve, control pressure of the hydraulic cylinders, and hydraulic circuits, each of which includes the servo motor, control die cushion pressure of the hydraulic cylinders.

12 Claims, 10 Drawing Sheets

(51) Int. Cl.
*B21D 24/14* (2006.01)
*B30B 15/06* (2006.01)

(58) Field of Classification Search
CPC ..... B30B 15/183; B30B 15/186; B30B 15/20; B30B 15/22; B30B 15/26; B30B 15/061
See application file for complete search history.

(56) References Cited

U.S. PATENT DOCUMENTS

| | | | | |
|---|---|---|---|---|
| 6,205,828 | B1 * | 3/2001 | Nagao | B21J 9/12 72/19.9 |
| 2008/0134909 | A1 * | 6/2008 | Kohno | B30B 1/18 100/48 |
| 2009/0071218 | A1 | 3/2009 | Kohno et al. | |
| 2011/0226141 | A1 | 9/2011 | Kohno | |

FOREIGN PATENT DOCUMENTS

| | | | |
|---|---|---|---|
| JP | 2006-315074 | A | 11/2006 |
| WO | 2010/058710 | A1 | 5/2010 |

OTHER PUBLICATIONS

Extended European Search Report dated Dec. 5, 2016, issued in corresponding European Patent Application No. 16176079.8.

* cited by examiner

RELATED ART

DIE CUSHION-CUM-SLIDE CUSHION DEVICE AND METHOD OF CONTROLLING THE SAME

CROSS-REFERENCE TO RELATED APPLICATIONS

This Application claims priority to Japanese Patent Application No. 2015-138928 filed Jul. 10, 2015, the subject matter of which is incorporated herein by reference in entirety.

BACKGROUND OF THE INVENTION

Field of the Invention

The present invention relates to a die cushion-cum-slide cushion device and a method of controlling the same, and more particularly to a technique of allowing a servo motor used for the die cushion device to be also used for the slide cushion device.

Description of the Related Art

Heretofore, a servo die cushion device using a servo motor has been described in Patent Literature 1 (Japanese Patent Application Laid-Open No. JP 2006-315074 A) and Patent Literature 2 (International Publication No, WO 2010/058710 A1).

The die cushion device described in Patent Literature 1 is configured to allow a lower chamber (pressure generating chamber) of a hydraulic cylinder supporting a cushion pad to be directly connected to a discharge port of a hydraulic pump/motor so that torque of a servo motor connected to a rotating shaft of the hydraulic pump/motor is controlled to enable pressure (die cushion force) in the lower chamber of the hydraulic cylinder to be controlled.

The die cushion device described in Patent Literature 1 requires a servo motor of large capacity that can supply all power required for die cushioning simultaneously with the die cushioning. If a servo motor increases in capacity, a die cushion device increases in size, as well as power-receiving equipment increases in capacity.

The die cushion device described in Patent Literature 2 is configured to allow a proportional valve and a hydraulic pump/motor to be connected in parallel with a lower chamber of a hydraulic cylinder to reduce capacity of a servo motor for driving the hydraulic pump/motor so that opening of the proportional valve and torque of the servo motor are controlled when die cushion force is controlled.

SUMMARY OF THE INVENTION

FIG. 10 is a waveform chart illustrating slide position of a press machine, and die cushion position and die cushion force of a die cushion device, during one pressing cycle period.

As illustrated in FIG. 10, if one pressing cycle period is indicated as A, and a die cushion operating period, which includes a die cushion process in which die cushion force is applied to a cushion pad, and a knockout process including knockout operation of a product, is indicated as B, a ratio (B/A) of the die cushion operating period B to the one pressing cycle period A is at most 50%, and usually 20% to 30%. Thus, a servo motor of a conventional die cushion device does not operate in most part of the one pressing cycle period.

While the servo die cushion device has high functionality related to applying die cushion force (has an advantage), it has an aspect of being expensive (a disadvantage). Because, a servo motor with large capacity (motor capacity of a motor times required quantity) is required relative to the die cushion force (capability).

Although the die cushion device described in Patent Literature 2 uses a hydraulic pump/motor (and a servo motor) in combination with a proportional valve to enable capacity of a servo motor to be reduced, it is the same in that the servo motor does not operate in most part of one pressing cycle period. In addition, the proportional valve provided in parallel with the hydraulic pump/motor (and a servo motor) reduces an oil flow discharged from a hydraulic cylinder, and then the proportional valve causes pressure loss because the oil flow serves as a part of die cushion force. As a result, the die cushion device has energy efficiency less than that of a die cushion device having only the hydraulic pump/motor (and a servo motor).

The present invention is made in light of the above-mentioned circumstances, and it is an object to provide a die cushion-cum-slide cushion device and a method of controlling the same, in which a driving source including a servo motor used for the die cushion device is used for the slide cushion device to enable increasing an added value of the driving source including the servo motor that is relatively expensive.

To achieve the object described above, a die cushion-cum-slide cushion device in accordance with one aspect of the present invention includes: an upper cushion pad that supports an upper blank holder through an upper cushion pin; a first fluid-pressure cylinder that is provided in a slide of a press machine to support the upper cushion pad, and that applies slide cushion force to the upper blank holder when the slide descends; first piping that is capable of supplying pressure fluid through a check valve connected to a slide cushion pressure generating line connected to a pressure generating chamber of the first fluid-pressure cylinder; a fluid-pressure circuit that is connected to the slide cushion pressure generating line, and that includes a pressure control valve that releases pressure fluid pushed out from the pressure generating chamber of the first fluid-pressure cylinder to a low pressure source, the fluid-pressure circuit configured to generate the slide cushion force by controlling fluid pressure in the pressure generating chamber of the first fluid-pressure cylinder; a lower cushion pad that supports a lower blank holder through a lower cushion pin; a second fluid-pressure cylinder that supports the lower cushion pad, and that applies die cushion force to the lower blank holder; second piping that is connected to a pressure generating chamber of the second fluid-pressure cylinder; a fluid-pressure pump/motor that generates pressure fluid for driving the first fluid-pressure cylinder or the second fluid-pressure cylinder through the first piping or the second piping; a servo motor that is connected to a rotating shaft of the fluid-pressure pump/motor; a selector valve that is connected to the first piping and the second piping, and that switches opening and closing of a flow channel between the fluid-pressure pump/motor and the first fluid-pressure cylinder, and opening and closing of a flow channel between the fluid-pressure pump/motor and the second fluid-pressure cylinder; a valve controller that switches the selector valve so as to open the flow channel between the fluid-pressure pump/motor and the first fluid-pressure cylinder during a first period from a first time point before applying the slide cushion force is started to a second time point at least before applying the die cushion force is started after the first time point, in one pressing cycle period of the press machine, and that switches the selector valve so as to open the flow channel between the fluid-pressure pump/motor and the second fluid-pressure cylinder during a second period from the second time point to at least when applying the die cushion force is finished; a slide cushion controller that controls the servo motor to allow the first fluid-pressure cylinder to generate the slide cushion force during the first period from the first time point to the second time point; and a die cushion controller that controls the servo motor to allow the second fluid-pressure cylinder to generate the die cushion force during the second period.

According to one aspect of the present invention, pressure fluid discharged from the fluid-pressure pump/motor driven by the servo motor can be selectively supplied to the first fluid-pressure cylinder that generates slide cushion force, or the second fluid-pressure cylinder that generates die cushion force, through the selector valve. Then, before applying the slide cushion force is started, the servo motor is controlled to allow the first fluid-pressure cylinder to generate the slide cushion force.

Usually, the slide cushion force is generated when the upper cushion pad collides with a material through the upper blank holder while the slide descends to release pressure fluid pushed out from the pressure generating chamber of the first fluid-pressure cylinder while the slide descends after the collision to the low pressure source through the pressure control valve. Thus, after pushing out pressure fluid from the pressure generating chamber of the first fluid-pressure cylinder is started, the slide cushion force (required for forming) is generated after the slide moves through a predetermined descending stroke (after elapse of a predetermined response time). That is, a rising response of the slide cushion force is very slow. According to one aspect of the present invention, before applying the slide cushion force is started, the slide cushion force is generated. Thus, the slide cushion force can be generated from when applying the slide cushion force is started (when the upper cushion pad collides) to enable improving delay of the rising response of the slide cushion force. In addition, the driving source including the servo motor to be used in die cushion device in a period (surplus period) other than a period of a die cushion function is used as a driving source of the slide cushion device to increase an added value of the driving source including the servo motor. The driving source including the servo motor also supplies pressure fluid, and thus the pressure fluid can be easily applied to the first fluid-pressure cylinder or the second fluid-pressure cylinder by switching the selector valve.

In the die cushion-cum-slide cushion device in accordance with another aspect of the present invention, it is preferable that the pressure control valve of the fluid-pressure circuit includes: a logic valve of a pilot drive type that is provided between the slide cushion pressure generating line and a low pressure line connected to the low pressure source, and that is operable as a main relief valve when slide cushion force is applied; a pilot pressure generating line connected to the slide cushion pressure generating line through a throttle valve; and a pilot relief valve that is provided between the pilot pressure generating line and the low pressure line to allow the pilot pressure generating line to generate pilot pressure that controls the logic valve.

According to another aspect of the present invention, there is provided the relief valve of a pilot drive type (balance piston type) formed by combining the logic valve and the pilot relief valve. When slide cushion force is applied, the logic valve operates as the main relief valve to be able to generate slide cushion force (pressure) in accordance with pilot pressure generated by the pilot relief valve.

In the die cushion-cum-slide cushion device in accordance with yet another aspect of the present invention, it is preferable that the fluid-pressure circuit includes: a first solenoid valve that switches pressure applying to a pilot port of the logic valve to any one of the pilot pressure and low pressure of the low pressure source, during the one pressing cycle period; and a second solenoid valve that is provided between the slide cushion pressure generating line and the low pressure line to open and close connection between the slide cushion pressure generating line and the low pressure line. When the first solenoid valve is switched to apply the pilot pressure to the pilot port of the logic valve, slide cushion pressure corresponding to the pilot pressure can be generated in the slide cushion pressure generating line. In addition, when the first solenoid valve is switched to apply low pressure to the pilot port of the logic valve, the slide cushion pressure generated in the slide cushion pressure generating line is released. After the pressure is released, the upper cushion pad can be stopped near a position when the pressure is released. Then, allowing the second solenoid valve to open enables the upper cushion pad to perform descending (knockout) operation.

In the die cushion-cum-slide cushion device in accordance with yet another aspect of the present invention, it is preferable to include a controller that controls the first solenoid valve to be able to apply the pilot pressure to the pilot port of the logic valve in a period from before the first time point to when applying the slide cushion force is finished, and that controls the second solenoid valve to close connection between the slide cushion pressure generating line and the low pressure line in a period from before the first time point to when knocking-out by the upper cushion pad is started.

In the die cushion-cum-slide cushion device in accordance with yet another aspect of the present invention, it is preferable that the controller controls the first solenoid valve to enable low pressure of the low pressure source to be applied to the pilot port of the logic valve when applying the slide cushion force is finished, and controls the second solenoid valve to open the connection between the slide cushion pressure generating line and the low pressure line when the upper cushion pad starts knocking out after elapse of a locking period of the upper cushion pad from when applying the slide cushion force is finished. That is, low pressure of the low pressure source is applied to the pilot port of the logic valve when applying slide cushion force is finished to open the logic valve, and then pressure in the pressure generating chamber of the second fluid-pressure cylinder is released. Accordingly, the upper cushion pad is stopped near a position when the pressure is released, and when the slide rises, the upper cushion pad rises together with the slide (a locking process). After then, the connection between the slide cushion pressure generating line and the low pressure line is opened after elapse of the locking period of the upper cushion pad (when the upper cushion pad starts knocking out) so that low pressure of the low pressure source is supplied to the pressure generating chamber of the second fluid-pressure cylinder through the slide cushion pressure generating line to allow the upper cushion pad to relatively descend with respect to the slide.

In the die cushion-cum-slide cushion device in accordance with yet another aspect of the present invention, it is preferable to include a slide cushion force commanding unit that outputs a slide cushion force command, and a slide cushion force detector that detects slide cushion force generated by the first fluid-pressure cylinder, and also it is preferable that the slide cushion controller controls torque of the servo motor on the basis of the slide cushion force command and the slide cushion force detected by the slide cushion force detector so that the first fluid-pressure cylinder generates slide cushion force corresponding to the slide cushion force command.

According to yet another aspect of the present invention, controlling torque of the servo motor enables generating slide cushion force commanded by the slide cushion force commanding unit before applying slide cushion force is started.

In the die cushion-cum-slide cushion device in accordance with yet another aspect of the present invention, it is preferable to include a die cushion force commanding unit that outputs a die cushion force command, and a die cushion force detector that detects die cushion force generated by the second fluid-pressure cylinder, and it is also preferable that the die cushion controller controls torque of the servo motor on the basis of the die cushion force command and the die cushion force detected by the die cushion force detector so that the second fluid-pressure cylinder generates die cushion force corresponding to the die cushion force command That is, controlling torque of a servo motor with good responsivity enables reducing surge pressure when control of die cushion force is started. Accordingly, the control can be performed quickly in response to a die cushion force command.

In the die cushion-cum-slide cushion device in accordance with yet another aspect of the present invention, it is preferable to include a proportional valve that is connected in parallel with the fluid-pressure pump/motor to release a part of pressure fluid, which is pushed out from the pressure generating chamber of the second fluid-pressure cylinder when die cushion force is applied, to the low pressure source, and it is also preferable that the die cushion controller controls torque of the servo motor and opening of the proportional valve on the basis of the die cushion force command and the die cushion force detected by the die cushion force detector no that the second fluid-pressure cylinder generates die cushion force corresponding to the die cushion force command.

According to yet another aspect of the present invention, there are provided a control function of a fluid-pressure servo type that performs throttle control in the proportional valve, and a control function of an electric servo type that uses a fluid-pressure pump/motor (and a servo motor), together, to control opening of the proportional valve and torque of the servo motor, whereby die cushion force corresponding to a die cushion force command is generated. Particularly, the amount of fluid pushed out from the second fluid-pressure cylinder when die cushion force is applied can be discharged through the proportional valve and the fluid-pressure pump/motor. Accordingly, as compared with the case where die cushion force is controlled by only a servo motor (and a fluid-pressure pump/motor), capacity of the servo motor can be reduced. As a result, the device can be reduced in size and price.

In the die cushion-cum-slide cushion device in accordance with yet another aspect of the present invention, it is preferable to include a regenerative unit that regenerates energy expended for allowing the second fluid-pressure cylinder to receive die cushion force when the die cushion force is applied in the press machine, as electric energy through the fluid-pressure pump/motor and the servo motor. Thus, energy expended for allowing the lower cushion pad to receive die cushion force when the die cushion force is applied in the press machine can be regenerated as electric energy through the second fluid-pressure cylinder, the fluid-pressure pump/motor, and the servo motor. As a result, the device has good energy efficiency.

In the die cushion-cum-slide cushion device in accordance with yet another aspect of the present invention, it is preferable to include a die cushion position detector that detects a position of the lower cushion pad, and it is also preferable that the die cushion controller controls the servo motor by using a die cushion position signal detected by the die cushion position detector, as a position feedback signal for allowing the lower cushion pad to move up and down at the time of knockout operation. Accordingly, a position of the second fluid-pressure cylinder (lower cushion pad) can be controlled to enable rising operation (knockout operation) to be stably performed.

The present invention in accordance with yet another aspect is a method of controlling the die cushion-cum-slide cushion device described above. The method includes the steps of: switching the selector valve by using the valve controller so as to open the flow channel between the fluid-pressure pump/motor and the first fluid-pressure cylinder during the first period; switching the selector valve by using the valve controller so as to open the flow channel between the fluid-pressure pump/motor and the second fluid-pressure cylinder during the second period; generating slide cushion force with the first fluid-pressure cylinder by allowing the slide cushion controller to control the servo motor during the first period from the first time point to the second time point; and generating die cushion force with at least the second fluid-pressure cylinder by allowing the die cushion controller to control the servo motor during the second period.

According to yet another aspect of the present invention, during the period from the first time point to the second time point (a surplus period until the die cushion function is started) in one pressing cycle period, pressure fluid discharged from the fluid-pressure pump/motor driven by the servo motor can be supplied to the first fluid-pressure cylinder by switching of the selector valve. On the other hand, during the second period in which the die cushion device functions, the pressure fluid discharged from the fluid-pressure pump/motor driven by the servo motor can be supplied to the second fluid-pressure cylinder by switching of the selector valve. Accordingly, the driving source including the servo motor, which is used in the die cushion device, is used in the slide cushion device in the surplus period to increase an added value of the driving source including the servo motor.

In the method of controlling the die cushion-cum-slide cushion device, in accordance with yet another aspect of the present invention, the second period includes a waiting period from the second time point until the slide collides with the lower cushion pad, and a knockout period from after the slide reaches a bottom dead center until reaching a standby position of the lower cushion pad. The method includes the step of: controlling the servo motor by the die cushion controller to keep the lower cushion pad waiting at the standby position during the waiting period; and controlling the servo motor by the die cushion controller to raise the lower cushion pad to the standby position during the knockout period.

According to the present invention, the driving source including the servo motor is used for the slide cushion device in the period (surplus period) other than the period of a die cushion function. Accordingly, an added value of the driving source including the servo motor that is relatively expensive can be increased. In addition, the servo motor is controlled to allow slide cushion force to be applied to the upper cushion pad of the slide cushion device before applying slide cushion force is started. Thus, it is possible to improve delay of a rising response of the slide cushion force controlled by the pressure control valve.

DETAILED DESCRIPTION OF THE EMBODIMENTS

With reference to accompanying drawings, preferable embodiments of a die cushion-cum-slide cushion device in accordance with the present invention will be described in detail below.

(Configuration of Die Cushion-Cum-Slide Cushion Device)

Figure 1:
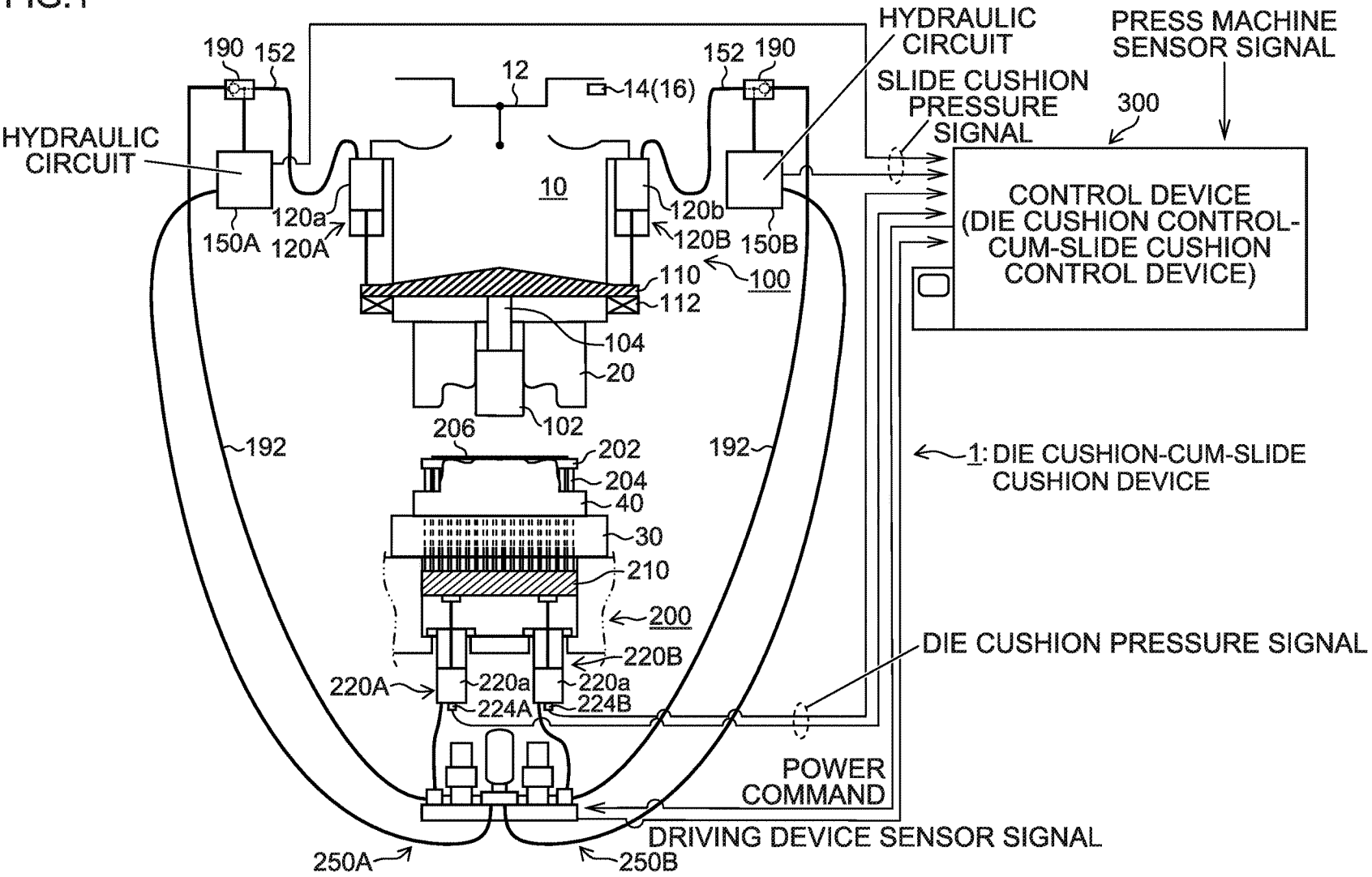
FIG. 1 is a constitution diagram illustrating an embodiment of a die cushion-cum-slide cushion device in accordance with the present invention.

FIG. 1 is a constitution diagram illustrating an embodiment of the die cushion-cum-slide cushion device in accordance with the present invention.

In FIG. 1, a press machine, which uses a die cushion-cum-slide cushion device 1 in accordance with the present invention, is a crank press provided with a slide 10 to which driving force is transmitted through a crank mechanism. The slide 10 is moved vertically in FIG. 1 by a crank mechanism including a crankshaft 12 to which rotational driving force is transmitted by a driving device. The crankshaft 12 includes a crank angle detector 14 that detects an angle of the crankshaft 12 (crank angle), and a crank angular velocity detector 16.

An upper die 20 is mounted on the slide 10, and a lower die 40 is mounted on a bolster 30 of the press machine.

As illustrated in FIG. 1, the die cushion-cum-slide cushion device 1 is composed of a slide cushion device 100, and a die cushion device 200.

(Slide Cushion Device)

The slide cushion device 100 includes: an upper (slide) blank holder 102; an upper cushion pad 110 that supports the upper blank holder 102 through an upper cushion pin 104; a plurality of hydraulic cylinders 120A and 120B (first fluid-pressure cylinders) that supports the upper cushion pad 110 and applies upward cushion force (slide cushion force) to the upper cushion pad 110; and a plurality of hydraulic circuits 150A and 150B (fluid-pressure circuits) that drives the plurality of hydraulic cylinders 120A and 120B, respectively.

The hydraulic cylinders 120A and 120B are connected to the slide 10, and move with the slide 10 to apply slide cushion force to the upper cushion pad 110 when the slide 10 descends. In FIG. 1, reference numeral 112 designates a projected limiting stopper for the upper cushion pad 110, and the projected limiting stopper 112 is provided on the slide 10.

The hydraulic circuits 150A and 150B are connected to pressure generating chambers (hydraulic chambers on a descending side) 120*a* and 120*b* of the hydraulic cylinders 120A and 120B, respectively, through a slide cushion pressure generating line 152, and allow the hydraulic cylinders 120A and 120B to generate slide cushion pressure (force) when slide cushion force is applied. Details thereof will be described later.

The slide cushion pressure generating line 152 is connected to piping (first piping) 192 through a check valve 190, and thus pressure oil (pressure fluid) can be supplied to the pressure generating chambers 120*a* and 120*b* of the hydraulic cylinders 120A and 120B from the hydraulic circuits 250A and 250B each of which serves as not only a die cushion driving device but also a slide cushion auxiliary driving device, described later, through the piping 192, the check valve 190, and the slide cushion pressure generating line 152.

(Die Cushion Device)

The die cushion device 200 includes: a lower (die) blank holder 202; a lower cushion pad 210 that supports the lower blank holder 202 through an lower cushion pin 204; a plurality of hydraulic cylinders 220A and 220B (second fluid-pressure cylinders) that supports the lower cushion pad 210 and applies downward cushion force (die cushion force) to the lower cushion pad 210; and a plurality of hydraulic circuits 250A and 250B that drives the plurality of hydraulic cylinders 220A and 220B, respectively.

The hydraulic cylinders 220A and 220B, respectively, include die cushion position detectors 224A and 224B each of which detects a position in an extending direction of a piston rod of each of the hydraulic cylinders as a position (die cushion position) of the lower cushion pad 210 in its lifting direction.

Between the upper die 20 and the lower die 40, a lower blank holder 202 is arranged so that a lower side thereof is supported by a cushion pad 210 through a plurality of cushion pins 204 and a material 206 is set on (brought into contact with) an upper side thereof.

(Hydraulic Circuits 150A and 150B)

Next, a configuration of each of the hydraulic circuits 150A and 150B illustrated in FIG. 1, which drive the hydraulic cylinders 120A and 120B, respectively, will be described.

Figure 2:
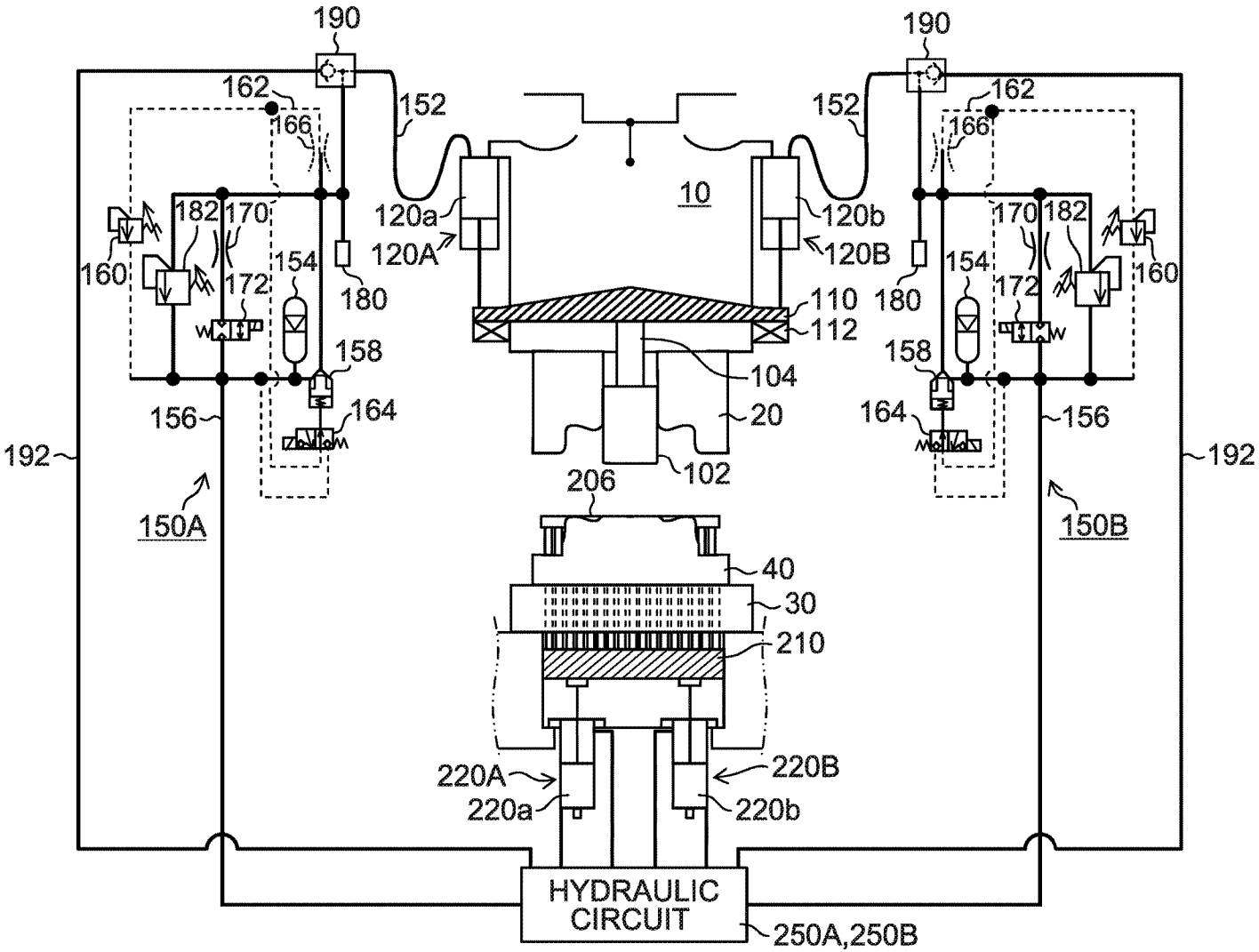
FIG. 2 is a constitution diagram of the die cushion-cum-slide cushion device, including a circuit diagram illustrating a hydraulic circuit illustrated in FIG. 1.

FIG. 2 is a constitution diagram of the die cushion-cum-slide cushion device, including a circuit diagram showing hydraulic circuits 150A and 150B illustrated in FIG. 1. Since each of the hydraulic circuits 150A and 150B has the same configuration, a configuration of the hydraulic circuit 150A will be described in detail, and detailed description of the hydraulic circuit 150B is omitted.

As illustrated in FIG. 2, the hydraulic circuit 150A includes: a low pressure line 156 that is connected to the pressure generating chamber 120*a* of the hydraulic cylinder 120A through the slide cushion pressure generating line 152 to be connected to an accumulator 154 that mainly accumulates low pressure oil; a logic valve 158 of a pilot drive type that is provided between the slide cushion pressure generating line 152 and the low pressure line 156 to be operable as a main relief valve when slide cushion force is applied; a pilot pressure generating line 162 that is connected to the slide cushion pressure generating line 152 through a throttle valve 166; and a pilot relief valve 160 that is provided between the pilot pressure generating line 162 and the low pressure line 156 to generate pilot pressure to control the logic valve 158. The accumulator 154 serves as a tank to be connected to an accumulator 261 in the hydraulic circuits 250A and 250B of the die cushion driving device (refer to FIG. 4) through the low pressure line 156. Accordingly, low pressure oil in both of the hydraulic circuits is balanced.

The hydraulic circuit 150A includes a first solenoid valve 164 that switches pressure applied to a pilot port of the logic valve 158 to any one of pilot pressure generated in the pilot pressure generating line 162 and low pressure of the low pressure line 156. The throttle valve (variable throttle valve) 166 is provided between the slide cushion pressure generating line 152 and the pilot pressure generating line 162 to adjust the pilot pressure.

Between the slide cushion pressure generating line 152 and the low pressure line 156, a throttle valve 170 and a second solenoid valve 172 are provided. The second solenoid valve 172 is preferably a poppet type whose turning on and off are controlled so that there is little leak (no leak) when turned off (fully closed).

The slide cushion pressure generating line 152 also includes a pressure detector 180 that serves as a slide cushion force detector. In FIG. 2, reference numeral 182 designates a relief valve that serves as a safety valve when abnormal slide cushion pressure is applied.

Specific timing of ON-OFF control of the first solenoid valve 164 and the second solenoid valve 172 will be described later. The ON-OFF control of the first solenoid valve 164 and the second solenoid valve 172 can be performed by a valve controller in a control device 300, however, may be performed by using a part of a controller of a press machine.

(Slide Cushion Pressure (Force) Control by Hydraulic Circuit 150A)

Next, slide cushion pressure control by the logic valve 158 and the pilot relief valve 160 in the hydraulic circuit 150A will be described.

In FIG. 2, when the upper cushion pad 110 descends with the slide 10 as the slide 10 of the press machine descends, the upper blank holder 102 supported by the upper cushion pad 110 through the upper cushion pin 104 collides (impacts) with the lower die 40 through the material 206. After the collision, the hydraulic cylinders 120A and 120B, descending with the slide 10, apply slide cushion force to the upper cushion pad 110, and the slide cushion force, which is determined by pressure and a cross-sectional area of the generating chambers 120*a* and 120*b* of the hydraulic cylinder 120A and 120B, is controlled by the logic valve 158 and the pilot relief valve 160.

Figure 3:
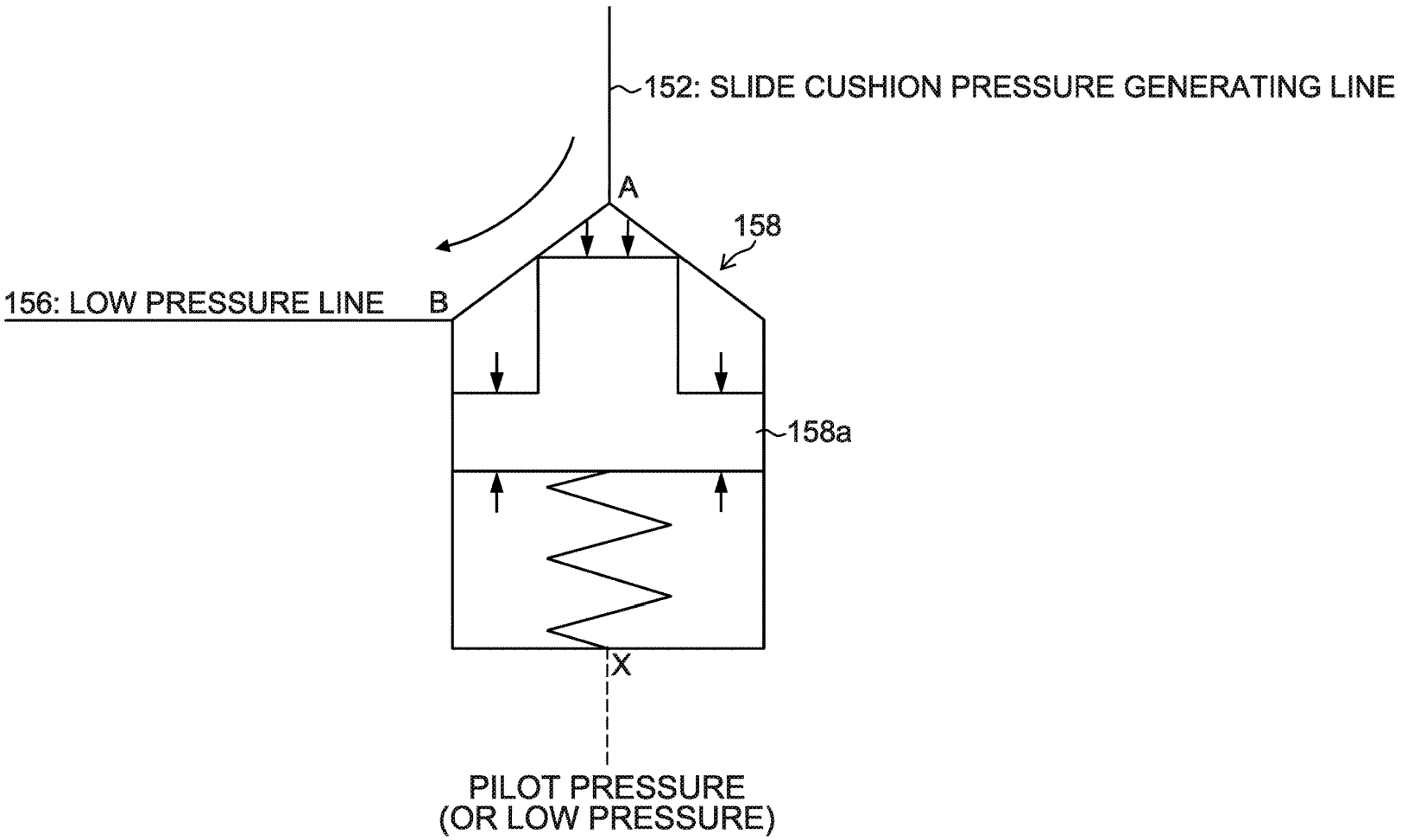
FIG. 3 is an enlarged view of a logic valve 158 illustrated in FIG. 2.

FIG. 3 is an enlarged view of the logic valve 158 illustrated in FIG. 2. In FIG. 3, the logic valve 158 is provided with an A port and a B port that are connected to the slide cushion pressure generating line 152 and the low pressure line 156, respectively, to receive the slide cushion pressure and the low pressure, respectively. In addition, the logic valve 158 is provided with a pilot port (X port) that is configured to receive the pilot pressure or the low pressure by turning on and off the first solenoid valve 164.

Hereinafter, area, pressure, and spring force of each of the ports of the logic valve 158 are designated by reference characters as follow:

$A_A$ is a pressurized area on the A port side;
$A_B$ is a pressurized area on the B port side;
$A_X$ is a pressurized area on the X port side;
$P_A$ is A port pressure (slide cushion pressure);
$P_B$ is B port pressure (low pressure);
$P_X$ is X port pressure (pilot pressure); and
F is spring force.

If Expression 1 shown below is satisfied, depressing force toward the X port side is applied to a poppet 158*a* of the logic valve 158 to open the valve, and if Expression 2 is satisfied, depressing force toward the A port side is applied to the poppet 158*a* of the logic valve 158 to close the valve.

$$A_A \cdot P_A + A_B \cdot P_B > A_X \cdot P_X + F \quad \text{[Expression 1]}$$

$$A_A \cdot P_A + A_B \cdot P_B < A_X \cdot P_X + F \quad \text{[Expression 2]}$$

In Expressions 1 and 2, $A_A$, $A_B$, $A_X$, $P_B$, and F are constant, and thus the logic valve 158 is opened and closed in accordance with balance between the slide cushion pressure (A port pressure) $P_A$ and the pilot pressure (X port pressure) $P_X$.

The pilot pressure $P_X$ is also adjustable by pressure setting in the pilot relief valve 160, and thus the logic valve 158 can adjust the slide cushion pressure (force) in accordance with the pilot pressure (relief pressure) set in the pilot relief valve 160.

Returning to FIG. 2, the first solenoid valve 164 is turned on and off to apply the pilot pressure or the low pressure to the pilot port (X port) of the logic valve 158, as described before. When the first solenoid valve 164 is turned on and the low pressure is applied to the pilot port of the logic valve 158, the logic valve 158 opens. Then, pressure of the slide cushion pressure generating line 152 (the pressure generating chamber 120*a* of the hydraulic cylinder 120A) is reduced to pressure $P_A'$ caused by adding pressure ($F/A_A$) caused by the spring force F of the logic valve 158 to the pressure $P_B$ of low pressure line 156.

$$(A_A \cdot P_A' = A_A \cdot P_B + F \rightarrow P_A' = P_B + F/A_A)$$

At this time, slight (small) pressure (difference) is caused by the spring force F. After the pressure is released at a bottom dead center, the slide 10 rises to allow the upper blank holder 102 to separate from a material (product). Then, the hydraulic cylinders 120A and 120B interlocking with the upper cushion pad 110 become unconstrained, volume of the pressure generating chambers 120*a* and 120*b* of the hydraulic cylinders 120A and 120B is reduced a little by about 1 mm downward in a process in which the pressure $P_A'$ caused by adding pressure ($F/A_A$) caused by the spring force F of the logic valve 158 to the pressure $P_B$ of low pressure line 156 is eliminated (released). When the pressure $P_A'$ is eliminated, or although description is omitted, briefly when the pressure $P_A'$ is reduced to a pressure value at which upward force caused by pressure applied to pressurizing chambers on a rising side of the hydraulic cylinders 120A and 120B, and gravity acting on a movable mass interlocking with the upper cushion pad and downward force caused by the pressure, are balanced, force depressing the upper cushion pad 110 downward is eliminated to stop the upper cushion pad 110 at its position. That is, the upper cushion pad 110 rises together with the slide 10, and then is fixed so as not to move with respect to the slide 10.

In this way, the first solenoid valve 164 not only serves to release pressure applied to the upper cushion pad 110, but also serves to stop the upper cushion pad 110 at its position (locking function).

The second solenoid valve 172 is turned on when knocking out by the upper cushion pad 110 is started after elapse of a locking period of the upper cushion pad 110 after the first solenoid valve 164 is turned on and pressure in the pressure generating chamber 120*a* of the hydraulic cylinder 120A is released. Accordingly, low pressure oil can be supplied to the pressure generating chamber 120*a* of the hydraulic cylinder 120A from the low pressure line 156 maintained by the accumulator 154 through the throttle valve 170 and the slide cushion pressure generating line 152. Then, the hydraulic cylinder 120A extends its piston rod by using low pressure oil supplied to the pressure generating chamber 120*a* and self-weight of the upper cushion pad 110 and the like until the upper cushion pad 110 is brought into contact with the projected limiting stopper 112, thereby allowing the upper cushion pad to perform descending (knocking out) operation. The throttle valve 170 regulates the amount of oil to be supplied to the hydraulic cylinder 120A to regulate descent velocity of the upper cushion pad 110.

(Hydraulic Circuits 250A and 250B)

Next, a configuration of each of the hydraulic circuits 250A and 250B illustrated in FIGS. 1 and 2, which drive the hydraulic cylinders 220A and 220B, respectively, will be described.

Figure 4:
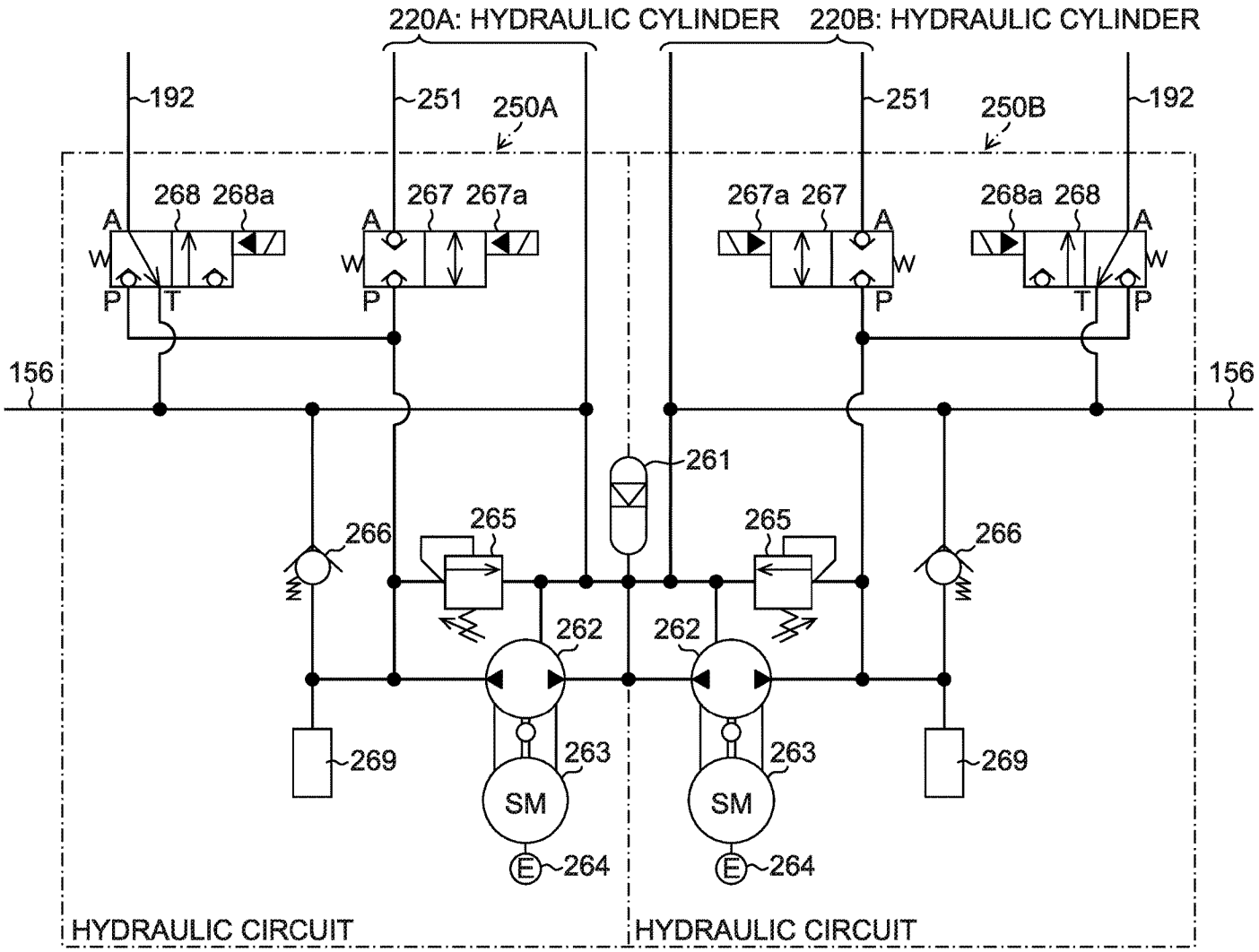
FIG. 4 is a circuit diagram illustrating an embodiment of hydraulic circuits 250A and 250B.

FIG. 4 is a circuit diagram illustrating an embodiment of hydraulic circuits 250A and 250B. Since each of the hydraulic circuits 250A and 250B has the same configuration, a configuration of the hydraulic circuit 250A will be described in detail, and detailed description of the hydraulic circuit 250B is omitted.

As illustrated in FIG. 4, the hydraulic circuit 250A includes the accumulator 261, a hydraulic pump/motor 262, a servo motor 263 connected to a rotating shaft of the hydraulic pump/motor 262, a motor angular velocity detector 264 that detects angular velocity (motor angular velocity w) of a drive shaft of the servo motor 263, a relief valve 265, a check valve 266, a 2-port, 2-position solenoid selector valve 267 (hereinafter referred to as simply a "first selector valve"), and a 3-port, 2-position solenoid selector valve 268 (hereinafter referred to as simply a "second selector valve").

The accumulator 261, in which low gas pressure is applied, not only serves as a tank, but also serves to supply oil under substantially constant low pressure to a port P of each of the first selector valve 267 and the second selector valve 268 through the check valve 266 to allow pressure of the pressure oil to be easily increased when the hydraulic pump/motor 262 is driven. The accumulator 261 is used in common by the hydraulic circuits 250A and 250B, and is connected to the accumulator 154 (refer to FIG. 2) of the hydraulic circuits 250A and 250B of the die cushion driving device through the low pressure line 156 as described before.

One port (discharge port) of the hydraulic pump/motor 262 is connected to the port P of each of the first selector valve 267 and the second selector valve 268, and the other port is connected to the accumulator 261. The hydraulic pump/motor 262 is driven by the servo motor 263 to supply pressure oil to the port P of the first selector valve 267 and the port P of the second selector valve 268.

The relief valve 265 is provided as a device that operates to prevent a hydraulic machine from breaking when abnormal pressure occurs, or when abnormal pressure suddenly occurs due to inoperative die cushion force control or slide cushion force control. In FIG. 4, reference numeral 269 designates a pressure detector corresponding to the die cushion force detector, and the pressure detector 269 detects pressure (die cushion pressure) in the pressure generating chamber 120*a* of the hydraulic cylinder 120A.

When a solenoid 267*a* of the first selector valve 267 is energized, or the first selector valve 267 is turned on, the first selector valve 267 opens to open a flow channel between the hydraulic pump/motor 262 and piping 251, or to connect the port P and the port A of the first selector valve 267 to each other. Accordingly, pressure oil can be supplied to the pressure generating chamber 220*a* of the hydraulic cylinder 220A from the hydraulic pump/motor 262 through the first selector valve 267, or pressure oil discharged from the pressure generating chamber 220*a* of the hydraulic cylinder 220A, when die cushion is applied, can flow into the hydraulic pump/motor 262 through the first selector valve 267.

On the other hand, when the solenoid 267*a* of the first selector valve 267 is demagnetized, or the first selector valve 267 is turned off, the first selector valve 267 closes to close the flow channel between the hydraulic pump/motor 262 and the piping 251, or to disconnect the port P and the port A of the first selector valve 267 from each other. Accordingly, the lower cushion pad 210 and the like are held against self-weight of the lower cushion pad 210 and the like.

When a solenoid 268*a* of the second selector valve 268 is energized, or the second selector valve 268 is turned on, the second selector valve 268 opens to open a flow channel between the hydraulic pump/motor 262 and piping 192, or to connect the port P and the port A of the second selector valve 268 to each other. Accordingly, the hydraulic circuits 250A and 250B are switched to a state where pressure oil can be supplied to the piping 192 that is connected to the check valve 190 and the slide cushion pressure generating line 152 (refer to FIG. 2) from the hydraulic pump/motor 262 through the second selector valve 268.

On the other hand, when the solenoid 268*a* of the second selector valve 268 is demagnetized, or the second selector valve 268 is turned off, the second selector valve 268 closes to close the flow channel between the hydraulic pump/motor 262 and the piping 192, or to disconnect the port P and the port A of the second selector valve 268 from each other. Accordingly, supply of pressure oil to the piping 192 (hydraulic cylinder 120A) from the hydraulic pump/motor 262 is interrupted.

The control device 300 performs ON-OFF control of the first selector valve 267 and the second selector valve 268. That is, a valve controller 307 (refer to FIG. 5) included in the control device 300 performs the ON-OFF control of the first selector valve 267 and the second selector valve 268 on the basis of a press machine sensor signal, such as a crank angle signal created by the crank angle detector 14. Details of timing of the ON-OFF control will be described later.

For the first selector valve 267 and the second selector valve 268, not only a solenoid selector valve of a poppet type with a minute internal leakage, but also a pilot drive check valve and the like, are available.

(Principle of Die Cushion Force Control)

Since die cushion force can be expressed by the product of pressure in the pressure generating chambers 220*a* and 220*b* of the respective two hydraulic cylinders 220A and 220B and surface area of the respective cylinders, controlling of the die cushion force means controlling of the pressure in the pressure generating chambers 220*a* and 220*b* of the hydraulic cylinders 220A and 220B. Each of the two hydraulic cylinders 220A and 220B can be independently controlled, and a case of controlling the hydraulic cylinder 220A will be described below. The hydraulic cylinder 220B also can be controlled as with the hydraulic cylinder 220A.

Static behavior can be expressed by the following expressions.

$$P=\int K((v\cdot a-k1\,Q\cdot\omega)/V)dt \quad \text{[Expression 3]}$$

$$t=k2\cdot Q/(2\pi) \quad \text{[Expression 4]}$$

In addition, dynamic behavior can be expressed by the following expressions along with Expressions 3 and 4.

$$P\cdot a-F_{slide}=M\cdot dv/dt+DS\cdot v+fS \quad \text{[Expression 5]}$$

$$T-t=I\cdot d\omega/dt+DM\cdot\omega+fM, \text{ where} \quad \text{[Expression 6]}$$

a is cross-sectional area of the hydraulic cylinder 220A on a die cushion pressure generating side;

V is volume of the hydraulic cylinder 220A on the die cushion pressure generating side;

P is die cushion pressure;

T is driving torque of the servo motor 263;

t is load torque applied to the servo motor 263;

I is moment of inertia of the servo motor 263;

DM is a viscous resistance coefficient of the servo motor 263;

fM is friction torque of the servo motor 263;

Q is pushed-out volume of the hydraulic pump/motor 262;

$F_{slide}$ is force applied to a piston rod of the hydraulic cylinder 220A from a slide;

v is pad velocity when the pad is pressed by the press;

M is inertial mass of the piston rod of the hydraulic cylinder 220A, and the pad;

DS is a viscous resistance coefficient of the hydraulic cylinder 220A;

fS is frictional force of the hydraulic cylinder 220A;

ω is angular velocity of the servo motor 263 that is rotated by pressure oil;

K is a volume elastic coefficient of hydraulic oil; and k1 and k2 are constants of proportionality.

Expressions 3 to 6 described above mean the following: Force transmitted to the hydraulic cylinder 220A from the slide 10 through the lower cushion pad 210 compresses oil in the pressure generating chamber 220*a* of the hydraulic cylinder 220A to generate die cushion pressure; Simultaneously, the die cushion pressure allows the hydraulic pump/motor 262 to serve as a hydraulic motor to rotate the servo motor 263 when load torque generated by the hydraulic pump/motor 262 becomes equal to driving torque of the servo motor 263, thereby preventing the die cushion pressure from rising; And thus, the die cushion pressure (die cushion force) is determined in accordance with the driving torque of the servo motor 263.

(Control Device 300)

The control device 300 of the die cushion-cum-slide cushion device 1 (refer to FIG. 1) includes a slide cushion control device and a die cushion control device.

(Slide Cushion Control Device and Die Cushion Control Device)

Figure 5:
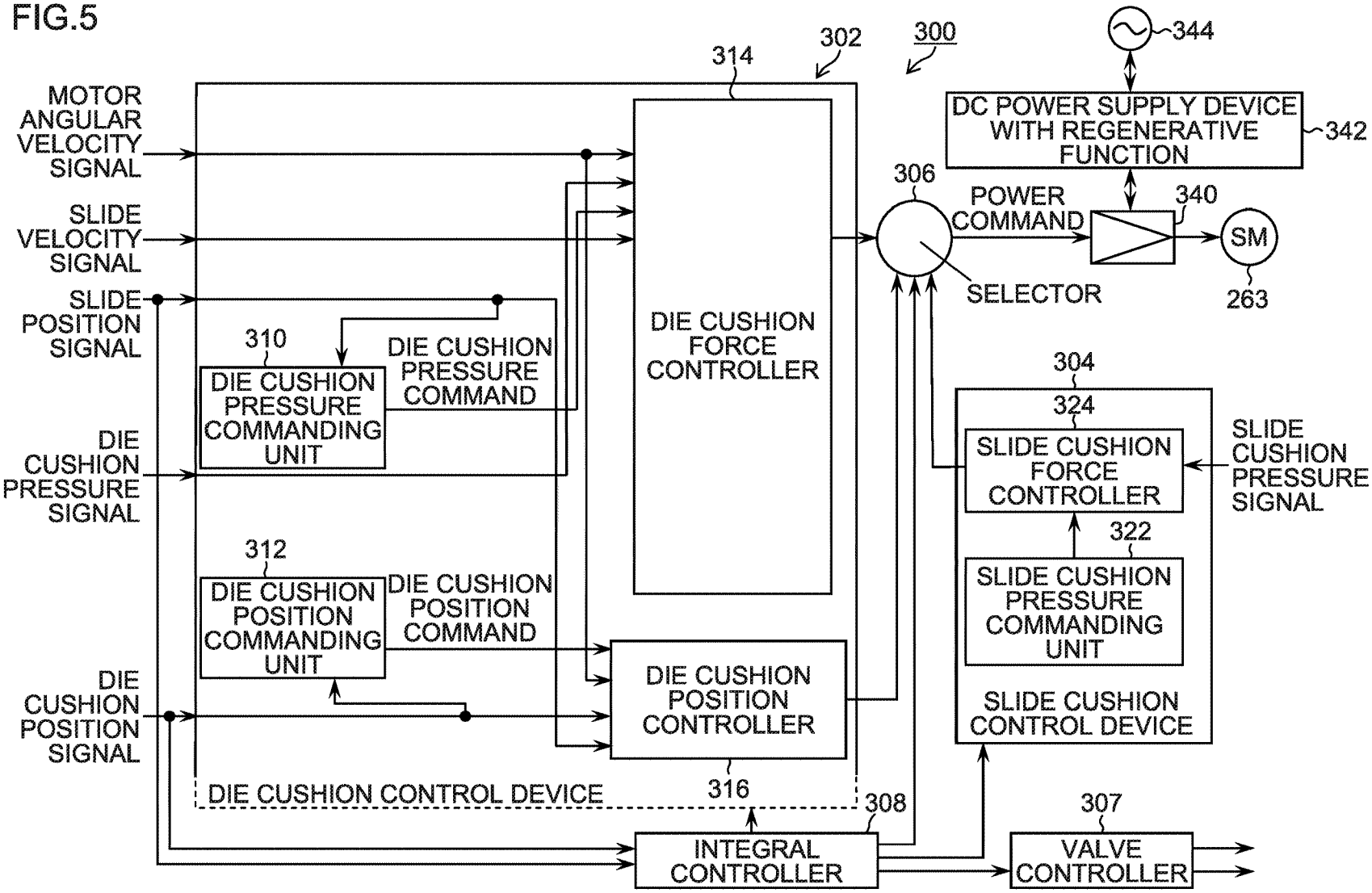
FIG. 5 is a block diagram illustrating an embodiment of a control device 300.

FIG. 5 is a block diagram illustrating an embodiment of a control device, and particularly illustrates the control device 300 that controls the hydraulic cylinder 120A of the slide cushion device 100, and the hydraulic cylinder 220A of the die cushion device 200. The control device 300 also controls the hydraulic cylinder 120B of the slide cushion device 100, and the hydraulic cylinder 220B of the die cushion device 200, as with the hydraulic cylinder 120A and the hydraulic cylinder 220A, and thus detailed description thereof is omitted.

In FIG. 5, the control device 300 includes: a die cushion control device 302 that mainly serves as a die cushion controller; a slide cushion control device 304 that serves as a slide cushion controller; a selector 306 that selects a power command (servo motor torque command); a valve controller 307 that controls the first solenoid valve 164, the second solenoid valve 172, the first selector valve 267, and the second selector valve 268; and an integral controller 308 that integrally controls the control devices, the selector, and the valve controller.

The die cushion control device 302 includes a die cushion force (pressure) commanding unit 310, a die cushion position commanding unit 312, a die cushion force (pressure) controller 314, and a die cushion position controller 316.

The die cushion control device 302 receives a slide position signal and a slide velocity signal, as a press machine sensor signal, and receives a motor angular velocity signal from the motor angular velocity detector 264, a die cushion pressure signal from the signal pressure detector 269, and a die cushion position signal from a die cushion position detector 224A, as a driving device sensor signal. The slide position signal and the slide velocity signal can be calculated on the basis of detection signals from the crank angle detector 14 and the crank angular velocity detector 16 (refer to FIG. 1), respectively.

In the die cushion pressure commanding unit 310 corresponding to a die cushion force commanding unit, a die cushion pressure value corresponding to a position of the slide 10 is preset, and the die cushion pressure commanding unit 310 outputs a die cushion pressure command to the die cushion force controller 314 on the basis of the slide position signal.

The die cushion position commanding unit 312 receives the die cushion position signal, and when the slide 10 reaches the bottom dead center, the die cushion position commanding unit 312 outputs a die cushion position command to control a die cushion position (position of the lower cushion pad 210) so that knockout operation for a product after press working is performed and the lower cushion pad 210 is kept waiting at an initial position.

The die cushion force controller 314 creates a power command (power command to control die cushion force) to control torque of the servo motor 263 on the basis of the received die cushion pressure command and driving device sensor signal, and outputs the created power command to the selector 306. That is, after the slide 10 collides with the lower cushion pad 210, power of the slide 10 generates pressure in the pressure generating chamber 120*a* of the hydraulic cylinder 220A through the lower blank holder 202, the lower cushion pin 204, and the lower cushion pad 210. Then, pressure oil pushed out from the pressure generating chamber 120*a* of the hydraulic cylinder 220A flows into the hydraulic pump/motor 262 through the piping (second piping) 251 and the first selector valve 267 to allow the hydraulic pump/motor 262 to serve as a hydraulic motor to be rotated while the pressure oil is pushed out. At this time, the die cushion force controller 314 outputs a power command to apply torque of the servo motor 263 on a pressurizing side on the basis of the die cushion pressure command, a die cushion pressure signal, the slide velocity signal, and the motor angular velocity signal, which are received.

Although details of the selector 306 will be described later, the selector 306 selects a power command outputted from the die cushion force controller 314 during a die cushion process from after the slide 10 collides with the lower cushion pad 210 until reaching the bottom dead center. The power command selected by the selector 306 is outputted to the servo motor 263 through an amplifier/pulse width modulator 340.

During the die cushion process, power received by the lower cushion pad 210 from the slide 10 allows pressure oil to flow into the hydraulic pump/motor 262 from the pressure generating chamber 220*a* of the hydraulic cylinder 220A, and thus the hydraulic pump/motor 262 serves as a hydraulic motor. The servo motor 263 is driven by the hydraulic pump/motor 262 to serve as a generator. Electric power generated by the servo motor 263 is regenerated in an AC power source 344 as electric energy through the amplifier/pulse width modulator 340 and a DC power supply device 342 with a regenerative function, serving as a regenerative unit.

The die cushion position controller 316 creates a power command (power command to control a die cushion position) to control torque of the servo motor 263, on the basis of the die cushion position command received from the die cushion position commanding unit 312, and the driving device sensor signal, and outputs the created power command to the selector 306. That is, when the slide 10 reaches the bottom dead center (press forming is finished), the die cushion control device 302 is switched from a die cushion pressure control state to a die cushion position (holding) control state. In a die cushion position control state, the die cushion position controller 316 creates a power command to control a position of the lower cushion pad 210, on the basis of the die cushion position command, the die cushion position signal as a position feedback signal, and the angular velocity signal, which are received. At this time, the die cushion position controller 316 stops the lower cushion pad 210 for a predetermined time after the slide 10 starts rising, and then allows the hydraulic cylinder 220A (lower cushion pad 210) to rise to knock out a product that is in close contact with the lower die 40. Subsequently, the die cushion position controller 316 allows the hydraulic cylinder 220A to return to an initial position (standby position), and outputs a power command to prepare for a next cycle.

Although details of the selector 306 will be described later, the selector 306 selects a power command outputted from the die cushion position controller 316 during a knock-out process from after the slide 10 reaches the bottom dead center until reaching a standby position. The power command selected by the selector 306 is outputted to the servo motor 263 through an amplifier/pulse width modulator 340.

The slide cushion control device 304 includes a slide cushion pressure commanding unit 322, and a slide cushion force (pressure) controller 324.

The slide cushion pressure commanding unit 322 corresponding to a slide cushion force commanding unit outputs a preset slide cushion pressure command to the slide cushion force controller 324. The slide cushion pressure command is set at a value equal to or a little less than setting pressure of the logic valve 158 serving as a main relief valve, determined by the pilot relief valve 160 in the hydraulic circuits 150A and 150B.

The slide cushion force controller 324 receives a slide cushion pressure signal created by the pressure detector 180 (refer to FIG. 2) as another input. The slide cushion force controller 324 creates a power command (a power command to control slide cushion force) to control torque of the servo motor 263 on the basis of the slide cushion pressure command and the slide cushion pressure signal, which are received, and outputs the created power command to the selector 306.

Although details of the selector 306 will be described later, the selector 306 selects a power command inputted from the slide cushion control device 304 before slide cushion force is applied, and outputs the selected power command to the servo motor 263 through the amplifier/pulse width modulator 340. The selector 306 and the slide cushion control device 304 are integrated by the integral controller 308. Accordingly, torque control of the servo motor 263 enables slide cushion pressure commanded by the slide cushion pressure commanding unit to be generated in the pressure generating chamber 120*a* of the hydraulic cylinder 120A before slide cushion force is applied. Even if slide cushion force is applied to the upper cushion pad 110 through the hydraulic cylinders 120A and 120B before applying slide cushion force is started, the upper cushion pad 110 does not move (descend) relatively with the slide 10 because it is in contact with the projected limiting stopper 112.

(Method of Controlling Die Cushion-Cum-Slide Cushion Device)

Next, a method of controlling the die cushion-cum-slide cushion device, configured as described above, will be described.

Figure 6:
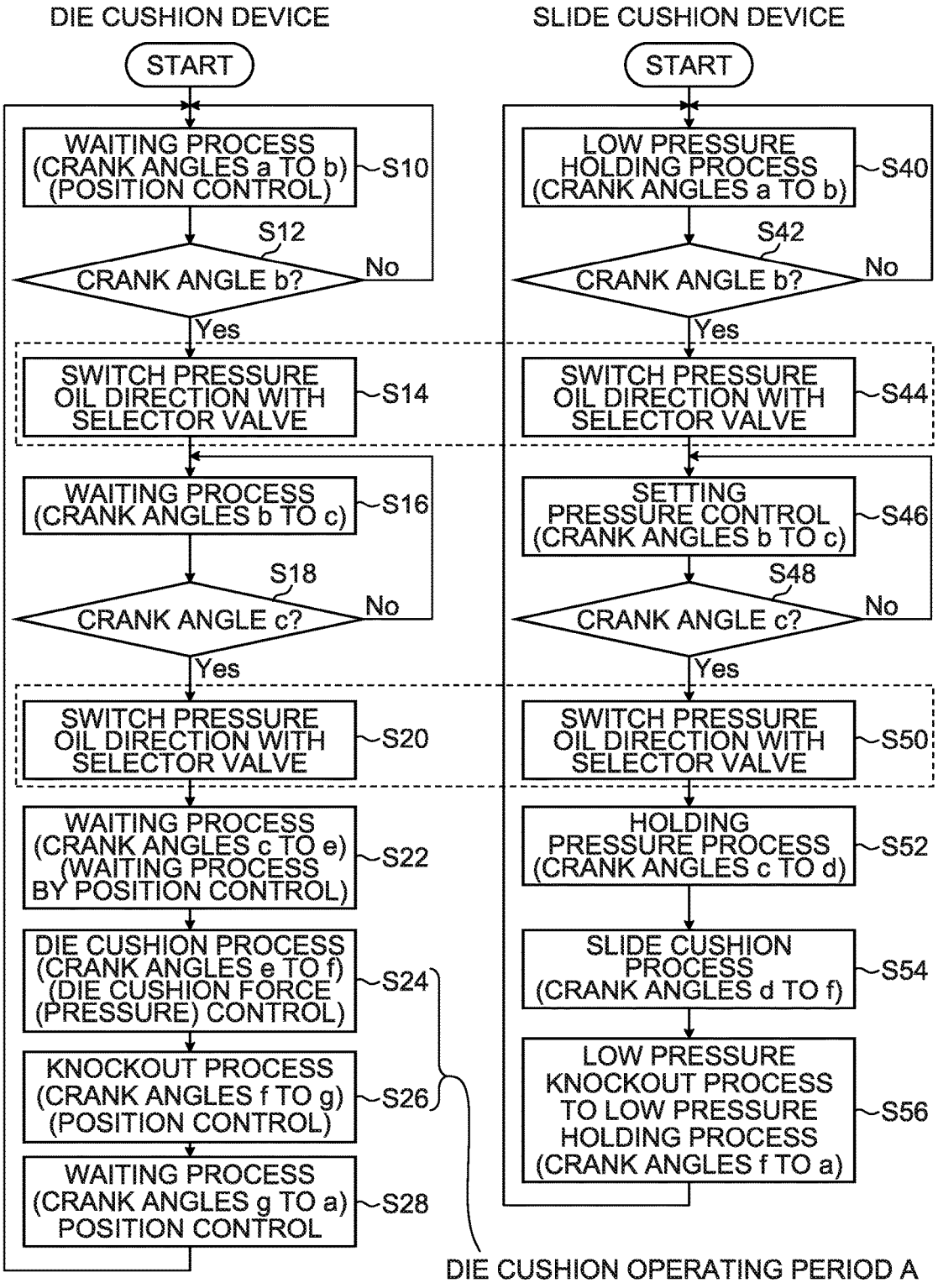
FIG. 6 is a flow chart illustrating an embodiment of a method of controlling the die cushion-cum-slide cushion device.
Figure 7:
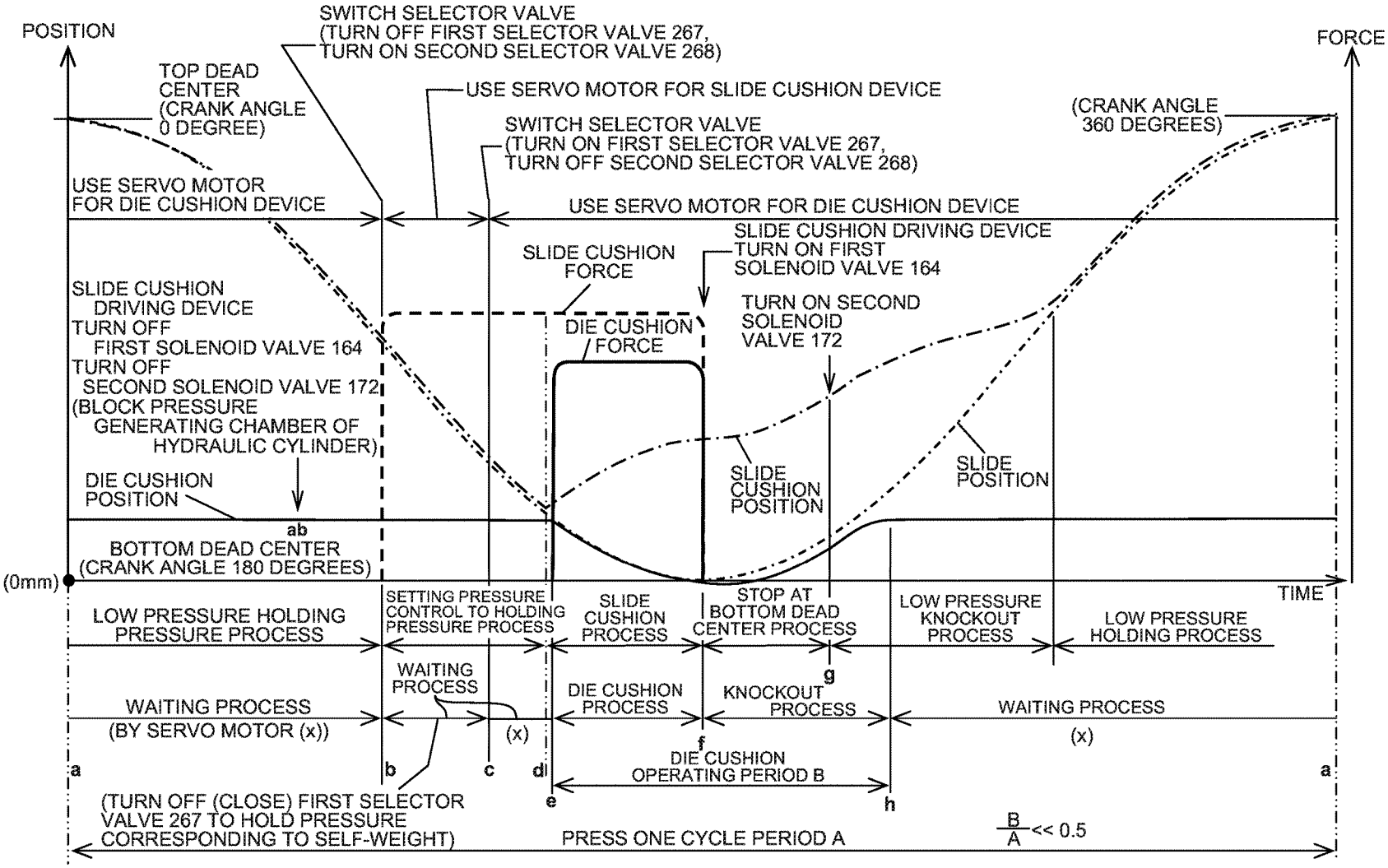
FIG. 7 is a graph illustrating slide position, slide cushion force, slide cushion position, die cushion force, and die cushion position, during one pressing cycle period.

FIG. 6 is a flow chart illustrating an embodiment of a method of controlling the die cushion-cum-slide cushion device, and FIG. 7 is a graph illustrating slide position, slide cushion force, slide cushion position, die cushion force, and die cushion position, during one pressing cycle period.

First, a method of controlling the die cushion device 200 will be described.

In FIGS. 6 and 7, the first selector valve 267 is turned on during a period from a top dead center (a crank angle "a" that is 0°) to a crank angle "b" in one pressing cycle period A of the press machine, and the die cushion device 200 is set to a die cushion position control state to control the lower cushion pad 210 to be positioned at a predetermined standby position (step S10, a waiting process). That is, the die cushion position controller 316 creates a power command to control a position of the lower cushion pad 210 on the basis of a die cushion position command indicating the standby position of the lower cushion pad 210, a die cushion position signal, and a servo motor angular velocity signal, and outputs the created power command to the servo motor 263 through the selector 306 and the amplifier/pulse width modulator 340. Accordingly, the lower cushion pad 210 is held at the predetermined standby position. Hereinafter, a waiting process in which the servo motor 263 is driven is referred to as a waiting process (x).

Subsequently, it is determined whether the waiting process in step S10 is finished, or whether the crank angle "b" is achieved, in the present example (step S12). When the crank angle "b" is achieved (in the case of "Yes"), the hydraulic circuit is switched by the selector valve, or the first selector valve 267 is turned off and the second selector valve 268 is turned on (step S14).

When the first selector valve 267 is turned off, the first selector valve 267 closes to hold lower cushion pad 210 and the like against self-weight of the lower cushion pad 210 and the like, and thus the lower cushion pad 210 is held at the present standby position (step S16).

Next, it is determined whether a crank angle "c" is achieved (step S18). When the crank angle "c" is achieved (in the case of "Yes"), the hydraulic circuit is switched again by the selector valve, or the first selector valve 267 is turned on (step S20).

In one pressing cycle of the press machine, a period (first period) from a first time point before applying slide cushion force is started (at the time when the crank angle "b" is achieved in the present example), to a second time point at least later than the first time point (at the time when the crank angle "c" is achieved in the present example), is a predetermined period before applying slide cushion force is started. As described later, the hydraulic circuits 250A and 250B, each of which includes the servo motor 263, are used for the slide cushion device 100 in the first period. On the other hand, a period to the second time point (at the time when the crank angle "c" is achieved in the present example), to at least when applying die cushion force is finished, in the one pressing cycle period A, or a period (second period) other than the first period in the one pressing cycle period A, is a period of a die cushion function, in which a die cushion device functions. The hydraulic circuits 250A and 250B, each of which includes the servo motor 263, are used for the die cushion device 200 at least in the second period.

In step S20, when the selector valve switches the hydraulic circuit (when the first selector valve 267 is turned on), the die cushion device 200 is set to the die cushion position control state again, as with step S10, in a period from the crank angle "c" to a crank angle "e", and thus the lower cushion pad 210 is controlled to be positioned at the standby position (step S22, the waiting process (x)).

When the slide 10 collides with the lower cushion pad 210 to achieve the crank angle "e", the die cushion device 200 is switched to the die cushion force (pressure) control state, and then die cushion force is controlled during a period from the crank angle "e" to the bottom dead center or a crank angle "f" (step S24, a die cushion process).

Subsequently, when the slide 10 reaches the bottom dead center (crank angle "f"), the die cushion device 200 is switched to the knockout process by the die cushion position control (step S26, the knockout process) during a period from the crank angle "f" to a crank angle "g". The die cushion process and the knockout process mainly constitute the die cushion operating period B of the die cushion device 200.

When the knockout process in step S26 is finished, the lower cushion pad 210 is controlled to be positioned at the standby position again (step S28, the waiting process (x)).

The waiting process (x) from step S28 to step S10 (a crank angle "h" to the crank angle "a", and the crank angles "a" to "b") is a series of position control processes. In step S22 of the present example (the waiting process (x) in a period from the crank angle "c" to the crank angle "e"), although position control is performed to allow the lower cushion pad 210 to wait at the standby position, position control may be performed to preliminarily accelerate the lower cushion pad 210 in a descending direction to reduce impact force when the slide 10 collides with the lower cushion pad 210.

Next, a method of controlling the slide cushion device 100 will be described as compared with operation of the die cushion device 200 described above.

In FIGS. 6 and 7, the first solenoid valve 164 and the second solenoid valve 172 are individually turned on in a period before a predetermined time point "ab" between the crank angle "a" and the crank angle "b" to connect the pressure generating chambers 120*a* and 120*b* of the hydraulic cylinders 120A and 120B to the accumulator 154 (low pressure line 156). Then, the pressure generating chambers 120*a* and 120*b* are held at low pressure accumulated in the accumulator 154 (step S40, a low pressure holding process). Accordingly, the upper cushion pad 110 is held while being in contact with the projected limiting stopper 112 (low pressure holding). After that, the first solenoid valve 164 and the second solenoid valve 172 are individually turned off at the predetermined time point "ab" before the crank angle "b" (the first time point) to disconnect the pressure generating chambers 120*a* and 120*b* of the hydraulic cylinders 120A and 120B from the accumulator 154 (the low pressure line 156).

Subsequently, it is determined whether the low pressure holding process in step S40 is finished, or whether the crank angle "b" is achieved, in the present example (step S42). When the crank angle "b" is achieved (in the case of "Yes"), the hydraulic circuit is switched by the selector valve, or the first selector valve 267 is turned off and the second selector valve 268 is turned on (step S44). At this time, after the first selector valve 267 is turned off, the second selector valve 268 is turned on. When the second selector valve 268 is turned on, the second selector valve 268 opens to enable pressure oil to be supplied to the pressure generating chambers 120*a* and 120*b* of the hydraulic cylinders 120A and 120B from the hydraulic circuits 250A and 250B, respectively, through the piping 192, the check valve 190, and the slide cushion pressure generating line 152.

When the second selector valve 268 is turned on, the hydraulic circuits 250A and 250B including, each of which includes the servo motor 263, are used for the slide cushion device 100 in a period from the crank angle "b" to the crank angle "c" (the first period). That is, the slide cushion force controller 324 creates a power command to control torque of the servo motor 263 on the basis of the slide cushion pressure command and the slide cushion pressure signal, which are received, and outputs the created power command to the servo motor 263 through the selector 306, and the amplifier/pulse width modulator 340. Then, pressure oil at setting pressure is supplied to the pressure generating chambers 120*a* and 120*b* of the hydraulic cylinders 120A and 120B from the hydraulic pump/motor 262 driven by the servo motor 263 through the second selector valve 268, the piping 192, the check valve 190, and the slide cushion pressure generating line 152 (step S46, a setting pressure control process). Accordingly, the upper cushion pad 110 is brought into contact with the projected limiting stopper 112 while receiving preset slide cushion pressure (force).

Next, it is determined whether the crank angle "c" is achieved (step S48). When the crank angle "c" is achieved (in the case of "Yes"), the hydraulic circuit is switched again by the selector valve, or the first selector valve 267 is turned on, as well as the second selector valve 268 is turned off (step S50). At this time, it is preferable that the first selector valve 267 is turned on after the second selector valve 268 is turned off.

When the second selector valve 268 is turned off, the pressure generating chambers 120*a* and 120*b* of the hydraulic cylinders 120A, and 120B are disconnected from each other by the check valve 190, in a period from the crank angle "c" to a crank angle "d", and then are held at setting pressure controlled by the slide cushion pressure command (step S52, a holding pressure process).

After that, when the crank angle "d" is achieved and the upper blank holder 102 held by the upper cushion pad 110 collides with the lower die 40 through the material 206, slide cushion pressure in proportion to slide cushion force is generated in the pressure generating chambers 120*a* and 120*b* of the hydraulic cylinders 120A and 120B by interaction of the logic valve 158, the throttle valve 166, and the pilot relief valve 160. That is, pilot pressure less than the slide cushion pressure is caused between the throttle valve 166 and the pilot relief valve 160 (pilot pressure generating line 162) in accordance with an oil flow (a flow rate of pressure oil per unit time) from the slide cushion pressure generating line 152 to the low pressure line 156, the oil flow being caused by the slide cushion pressure through the throttle valve 166, and the pilot relief valve 160. A poppet of the logic valve 158 receives the following pressure or force to balance force: slide cushion pressure that is mainly applied to pressurized area on a slide cushion pressure applying side; low pressure that is applied to pressurized area on a low pressure applying side; pilot pressure that is applied to pressurized area on a pilot pressure applying side (pressurized area on the X port side) through the first solenoid valve 164; spring force inside the logic valve inside; and fluid force that is applied to the logic valve 158 in a direction of blocking a flow of pressure oil from slide cushion pressure generating line 152 to low pressure line 156, or in a direction of closing the valve. A poppet position (opening) of the logic valve 158 is maintained in accordance with velocity of the upper cushion pad 110, and is maintained almost constant if the velocity is constant. During a series of the operations above, the slide cushion pressure is generated (step S54, a slide cushion process).

Subsequently, when the slide 10 reaches the bottom dead center (a crank angle "f") at which applying slide cushion force is finished, first the first solenoid valve 164 is turned on to allow the logic valve 158 to open to reduce pressure in the slide cushion pressure generating line 152 (the pressure generating chamber 120*a* of the hydraulic cylinder 120A) to pressure $P_A'$ caused by adding pressure caused by the spring force F of the logic valve to pressure in the low pressure line 156. After that, when the slide 10 rises, force pressing the upper cushion pad 110 downward, generated by the hydraulic cylinders 120A and 120B, is eliminated. As a result, the upper cushion pad 110 stops close to (a little below) a position at which the pressure is reduced until the slide 10 reaches a crank angle "g" (the locking process). Subsequently, when the slide 10 reaches the crank angle "g", or after elapse of a locking period during which the upper cushion pad 110 stops, the second solenoid valve 172 is turned on to supply low pressure oil to the pressure generating chamber 120*a* of the hydraulic cylinder 120A from the low pressure line 156 maintained by the accumulator 154 through the throttle valve 170 and the slide cushion pressure generating line 152 to allow the upper cushion pad 110 to descend relatively with the slide 10 until the upper cushion pad 110 is brought into contact with the projected limiting stopper 112 (step S56, from a low pressure knockout process to a pressure holding process).

As described above, the die cushion-cum-slide cushion device repeatedly performs control for the die cushion device 200, shown from step S10 to step S28, and control for the slide cushion device 100, shown from step S40 to step S56, every one pressing cycle.

(Another Embodiment of Hydraulic Circuit)

Figure 8:
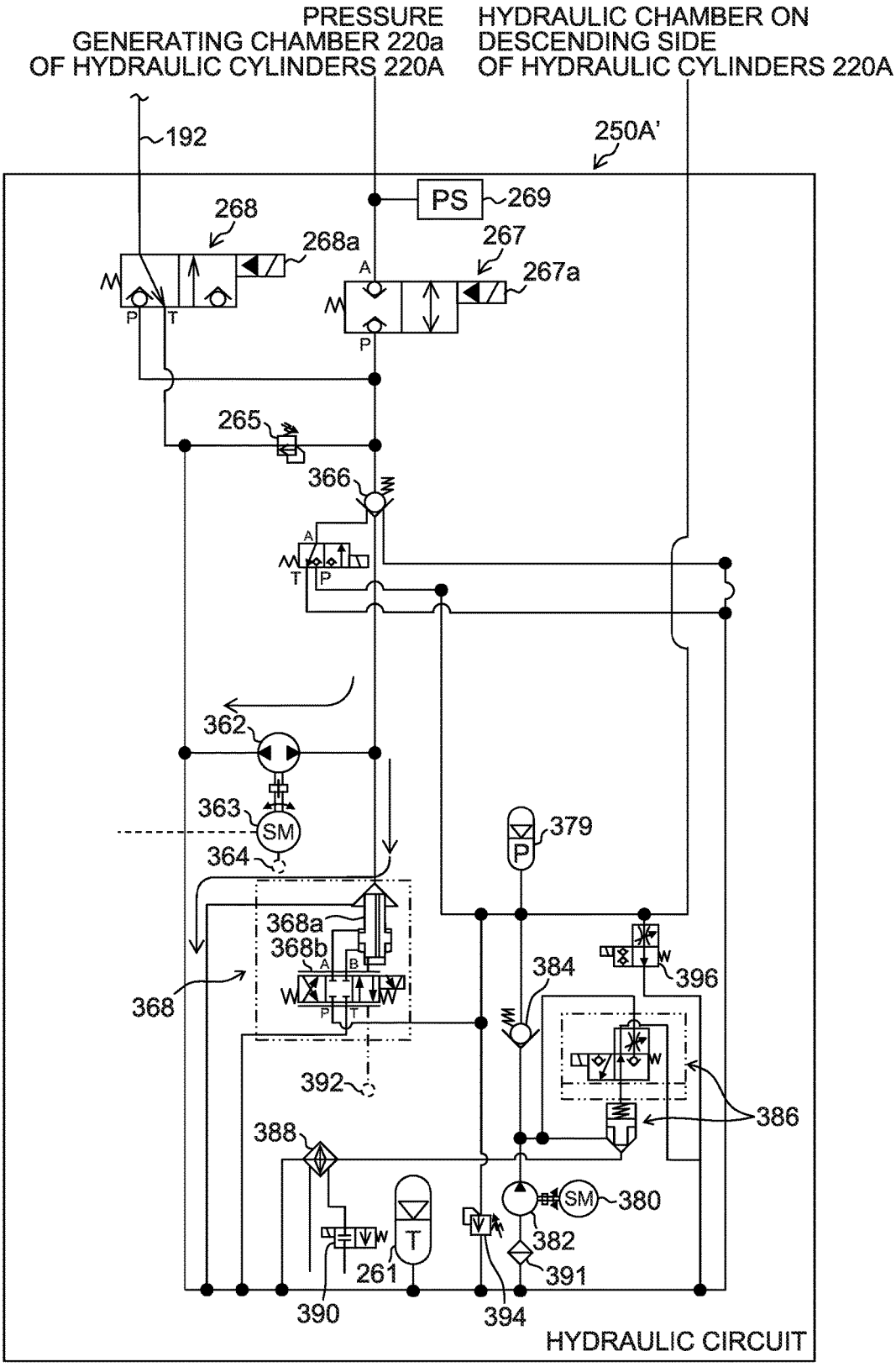
FIG. 8 is a circuit diagram illustrating another embodiment of the hydraulic circuit 250A.

FIG. 8 is a circuit diagram illustrating another embodiment of hydraulic circuit 250A.

FIG. 8 illustrates a hydraulic circuit 250A' that corresponds to the hydraulic cylinder 220A. The hydraulic circuit 250A' is different from the hydraulic circuit 250A illustrated in FIG. 4 in including a proportional valve 368. A portion common to the hydraulic circuit 250A illustrated in FIG. 4 is designated by the same reference numeral without duplicated description in detail.

The hydraulic circuit 250A' includes an accumulator 261 that is used as a low pressure source, a hydraulic pump/motor 362, a servo motor 363 connected to a rotating shaft of the hydraulic pump/motor 362, a motor angular velocity detector 364 that detects angular velocity of a drive shaft of the servo motor 363, a relief valve 265, a check valve 366, a proportional valve 368, a first selector valve 267, and a second selector valve 268.

Piping connected to a hydraulic chamber for descent of the hydraulic cylinder 220A is connected to an accumulator 379. The accumulator 379 accumulates pressure oil discharged from a hydraulic pump 382 driven by an electric motor 380, through a check valve 384. If the accumulator 379 sufficiently accumulates pressure oil, hydraulic oil discharged from the hydraulic pump 382 circulates in a hydraulic oil cooler 388 under low pressure through an unloading operation valve 386 to be cooled.

As described later, if pressure oil is released from the proportional valve 368 when die cushion force is applied, heat is generated due to squeezing action of the pressure oil, and thus hydraulic oil needs to be cooled. Reference numeral 390 designates a water solenoid valve for supplying cooling water to the hydraulic oil cooler 388, and reference numeral 391 designates a filter.

In the proportional valve 368 that is composed of a two-way valve 368*a* and a solenoid proportional flow control valve 368*b*, pressure oil accumulated in the accumulator 379 is used as pilot pressure to open and close the two-way valve 368*a* through the solenoid proportional flow control valve 368*b*. In a control state (drive state), the pressure oil is used as pilot pressure to forcibly open the check valve 366 of a forced opening drive type that is used to prevent the hydraulic cylinder 220A and the lower cushion pad 210 interlocked therewith from dropping due to their self-weight in an uncontrolled state (non-drive state). In addition, the pressure oil is used to be always applied to the pressure generating chamber 120*a* of the hydraulic cylinder 220A to serve as a part of a power source for allowing the hydraulic cylinder 120A to descend to facilitate accelerating operation during descending, such as during preliminary acceleration, as well as is used to facilitate up and down movement so that torque operation in one direction of the servo motor 363 enables the movement.

The proportional valve 368 is provided with a spool position detector 392 to detect opening of the proportional valve 368. Between the accumulator 379 and a low pressure side, a relief valve 394 and a solenoid direction selector valve (release pressure valve) 396 are individually connected.

The proportional valve 368 is provided in parallel with the hydraulic pump/motor 362 to release a part of the amount of oil discharged from the pressure generating chamber 120*a* of the hydraulic cylinder 120A to the low pressure side (an accumulator 261 side) while securing die cushion pressure and squeezing the oil, during the die cushion process in a case where slide velocity is large immediately after the die cushion force control is started. The hydraulic pump/motor 362 controlled by the servo motor 363 during the die cushion process pushes out and releases a part (a residue) of the amount of oil discharged from the pressure generating chamber 120*a* of the hydraulic cylinder 220A to the low pressure side by using the servo motor 363 during the die cushion process while securing the die cushion pressure and applying torque in a direction opposite to a rotation direction.

That is, the hydraulic circuit 250A" allows the proportional valve 368 to squeeze and release a part of the amount of oil discharged from the pressure generating chamber 120*a* of the hydraulic cylinder 220A during the die cushion process. Accordingly, as compared with a case where the oil is pushed out and released by only a hydraulic pump/motor and a servo motor, the hydraulic circuit enables processing of enormous large-capacity with even a small size (compact appearance). As a result, the die cushion pressure control is possible with no problem even if slide velocity is relatively fast when the die cushion pressure control is started.

Next, a principal of the die cushion pressure control, in which the hydraulic circuit 250A" is used, will be described.

Die cushion force applied to the hydraulic cylinder 220A is generated by controlling pressure in the pressure generating chamber 120*a* of the hydraulic cylinder 220A, or by controlling opening of the proportional valve 368, and torque of the hydraulic pump/motor 362.

Static behavior can be expressed by the following expressions.

$$P=\int K((v\cdot A-k1\,Q\cdot\omega-qv)/V)dt \quad \text{[Expression 7]}$$

$$qv=R\cdot Cv\sqrt{P} \quad \text{[Expression 8]}$$

$$t=k2\cdot PQ/(2\pi) \quad \text{[Expression 9]}$$

In addition, dynamic behavior can be expressed by the following expressions along with Expressions 6 and 7.

$$P\cdot A-F=M\cdot dv/dt+DS\cdot v+fS \quad \text{[Expression 10]}$$

$$T-t=I\cdot d\omega/dt+DM\cdot\omega+fM, \text{ where} \quad \text{[Expression 11]}$$

A is cross-sectional area of the hydraulic cylinder 220A on a die cushion pressure generating side;

V is volume of the hydraulic cylinder 220A on the die cushion pressure generating side;

P is die cushion pressure;

T is driving torque of the servo motor 363;

t is load torque applied to the servo motor 363;

I is moment of inertia of the servo motor 363;

DM is a viscous resistance coefficient of the servo motor 363;

fM is friction torque of the servo motor 363;

Q is pushed-out volume of the hydraulic pump/motor 362;

F is force applied to a piston rod of the hydraulic cylinder 220A from the slide 10;

v is cushion pad velocity when the cushion pad is pressed by the press;

M is inertial mass of the piston rod of the hydraulic cylinder 220A, and the cushion pad;

DS is a viscous resistance coefficient of the hydraulic cylinder 220A;

fS is frictional force of the hydraulic cylinder 220A;

ω is angular velocity of the motor that is rotated by pressure oil;

K is a volume elastic coefficient of hydraulic oil;

k1 and k2 are constants of proportionality;

qv is the amount of oil released by the proportional valve;

R is a commanded amount of the proportional valve; and

Cv is a flow rate coefficient of the proportional valve.

Expressions 7 to 11 described above mean the following: Force transmitted to the hydraulic cylinder 220A from the slide 10 through the lower cushion pad 210 compresses oil in the pressure generating chamber 220*a* of the hydraulic cylinder 220A to generate die cushion pressure (force);

The proportional valve 368 releases the amount of oil (controls the opening) while maintaining the die cushion pressure or controls opening, and simultaneously, the die cushion pressure allows the hydraulic pump/motor 362 to serve as a hydraulic motor to rotate the servo motor 363 when rotating shaft torque generated by the hydraulic pump/motor 362 becomes equal to driving torque of the servo motor 363, thereby preventing the die cushion pressure from rising; and Thus, the die cushion pressure is determined in accordance with the opening of the proportional valve 368 and the driving torque of the servo motor 363.

At this time, to stably control a die cushion pressure value at a preset value, the die cushion pressure P, the motor angular velocity co, and the cushion pad velocity v (or slide velocity) occurring when the cushion pad is pressed by the hydraulic cylinder, are detected to be used for compensation to determine the opening of the proportional valve 368 and the torque of the servo motor 363. In addition, a die cushion position is detected to control knockout operation of a product, and a slide position is detected to be used for acquiring timing of starting die cushion operation.

Figure 9:
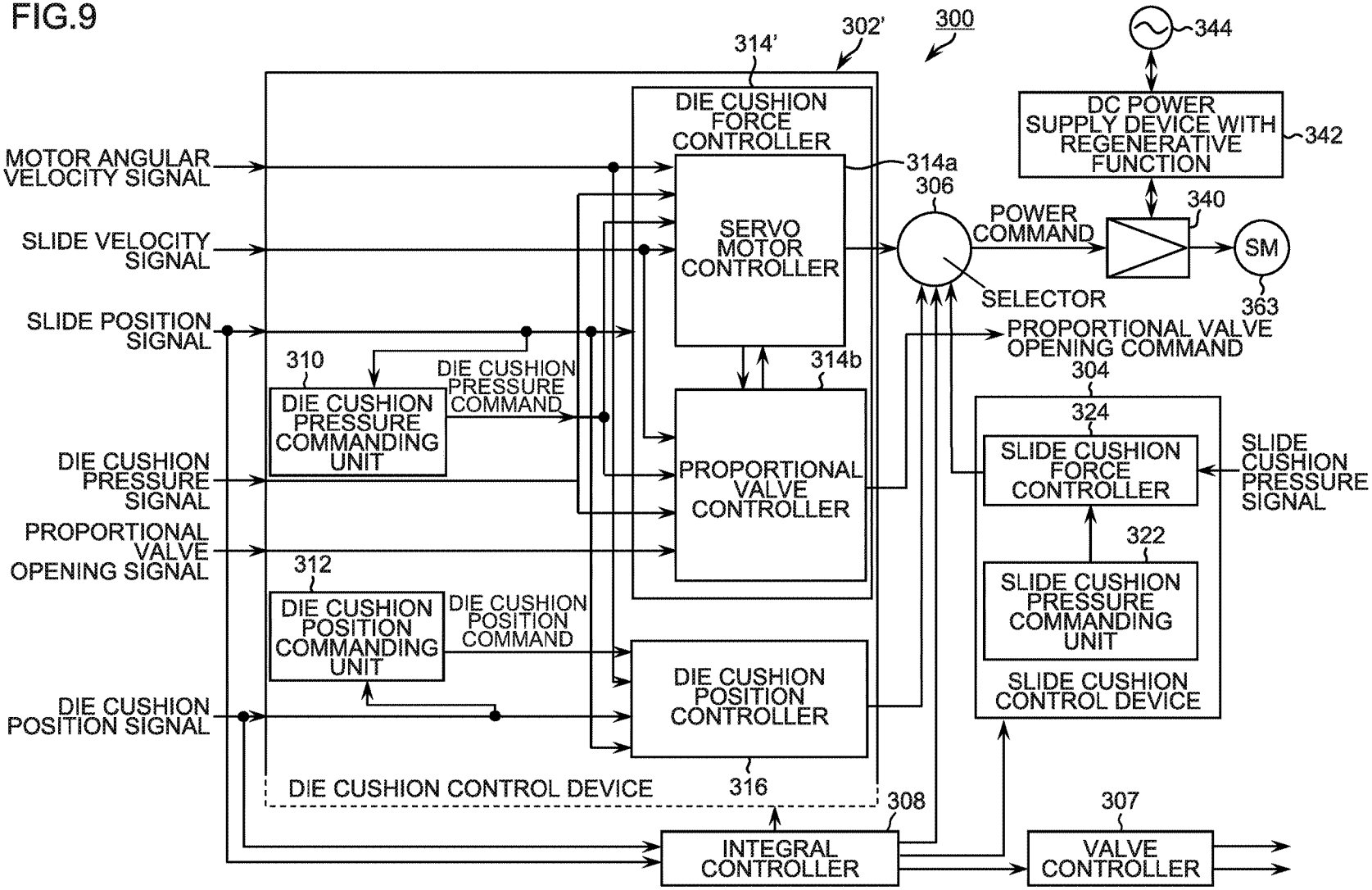
FIG. 9 is a block diagram of a control device of the die cushion-cum-slide cushion device when the hydraulic circuit illustrated in FIG. 8 is used.
Figure 10:
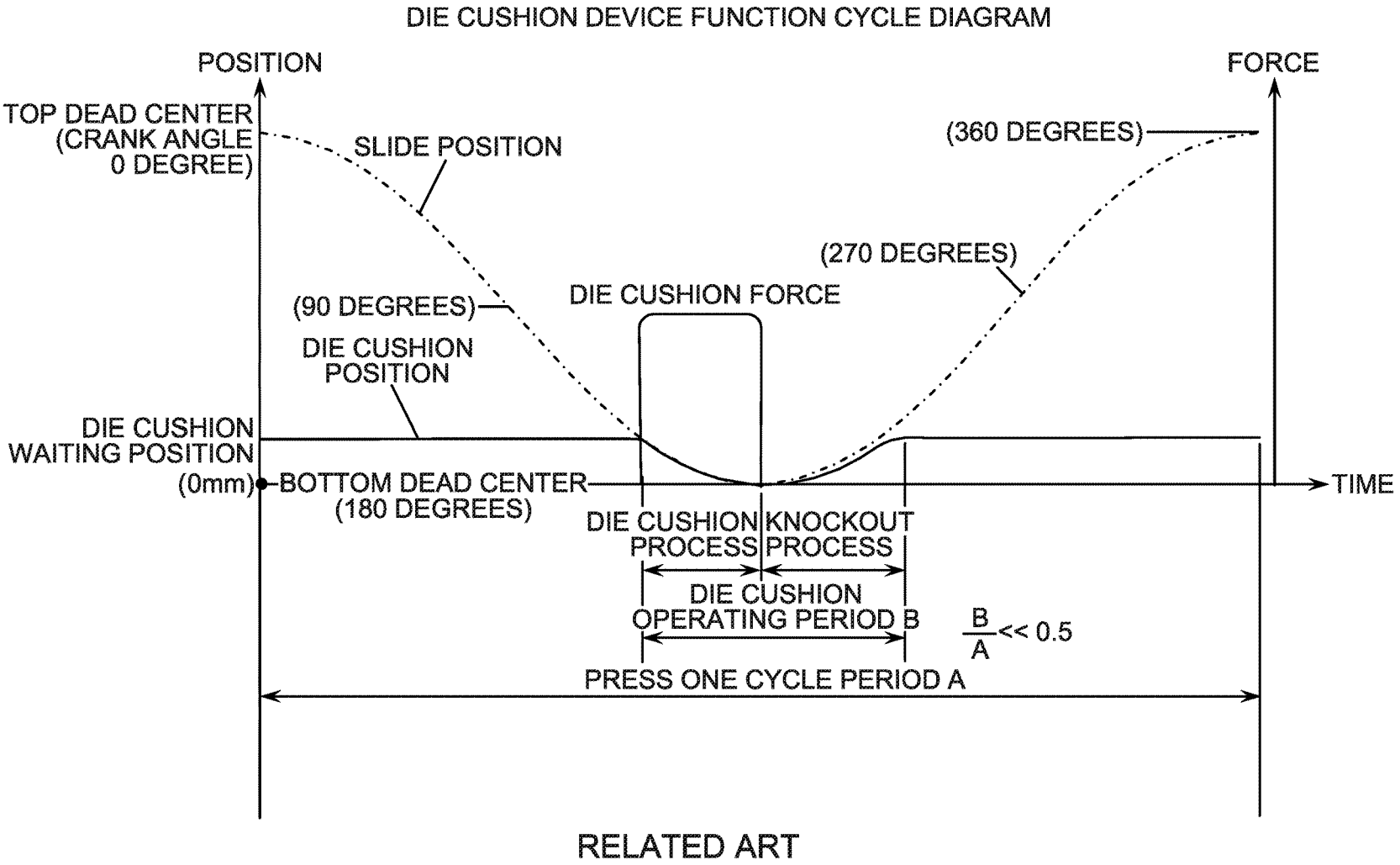
FIG. 10 is a waveform chart illustrating slide position of a press machine, and die cushion position and die cushion force of a die cushion device, during the one pressing cycle period.

FIG. 9 is a block diagram of the control device 300 (refer to FIG. 1) of the die cushion-cum-slide cushion device 1 when the hydraulic circuit 250A' described above is used. A portion common to the block diagram illustrated in FIG. 5 is designated by the same reference numeral without duplicated description in detail.

A die cushion control device is mainly different between the control device 300 illustrated in FIG. 9 and the control device 300 illustrated in FIG. 6, and particularly a die cushion force controller 314' of a die cushion control device 302' is different from the die cushion force controller 314 illustrated in FIG. 5.

The die cushion force controller 314' includes a servo motor controller 314*a*, and a proportional valve controller 314*b*.

The servo motor controller 314*a* and the proportional valve controller 314*b* individually receive a die cushion pressure command, a die cushion pressure signal, and a slide velocity signal. The servo motor controller 314*a* also receives a motor angular velocity signal, and the proportional valve controller 314*b* also receives a proportional valve opening signal.

The servo motor controller 314*a* creates a power command (a power command to control die cushion force) to control torque of the servo motor 363 on the basis of various received signals described above, and outputs the created power command to the selector 306. The proportional valve controller 314*b* outputs an opening command to control opening of the proportional valve 368 on the basis of the various received signals to the proportional valve 368.

As described before, after the slide 10 collides with the lower cushion pad 210, power of the slide 10 generates pressure in the hydraulic cylinder 220A through the lower blank holder 202, the lower cushion pin 204, and the lower cushion pad 210. Then, on one hand, pressure oil pushed out from the hydraulic cylinder 220A allows the hydraulic pump/motor 362 to serve as a hydraulic motor to be rotated while the pressure oil is pushed out. At this time, the servo motor controller 314*a* outputs a power command to apply torque of the servo motor 363 on a pressurizing side on the basis of the die cushion pressure command, the die cushion pressure signal, the slide velocity signal, the motor angular velocity signal, and the like, which are received.

On the other hand, the pressure oil pushed out from the hydraulic cylinder 220A is released to a low pressure side (a tank) through the proportional valve 368. At this time, the proportional valve controller 314*b* creates an opening command on the basis of the die cushion pressure command, the die cushion pressure signal, the slide velocity signal, the proportional valve opening signal, and the like, which are received, and outputs the created opening command to the proportional valve 368. Accordingly, die cushion pressure is generated by squeezing action of the pressure oil, caused by the proportional valve 368.

It is preferable that the proportional valve controller 314*b* controls opening of the proportional valve 368 in a mechanical press, such as a crank type and a link mechanism type, only if a production rate (cycle number/time) is fast, and a slide position is above the bottom dead center, and also slide velocity is large, for example, and preferable that the proportional valve controller 314*b* does not control the opening of the proportional valve 368 (the opening is set to 0 to be fully closed), if the production rate is slow (slide velocity is slow throughout a cycle), or the slide position becomes close to the bottom dead center to reduce the slide velocity even if the production rate is fast.

In a period during which the die cushion pressure control of torque control of the servo motor 363 by the servo motor controller 314*a*, and the die cushion pressure control of opening control of the proportional valve 368 by the proportional valve controller 314*b*, are simultaneously performed, the servo motor controller 314*a* and the proportional valve controller 314*b* control torque of the servo motor 363 and opening of the proportional valve 368, respectively, so that die cushion pressure controlled by both of the controllers in a coordinated manner becomes die cushion pressure indicated by the die cushion pressure command.

In the present example, when the second selector valve 268 is turned on to drive the slide cushion device 100, only the servo motor 363 is controlled while the proportional valve 368 is fully closed.

(Others)

Not only the first selector valve 267 and the second selector valve 268, illustrated in FIG. 4, but also selector valves with various configurations, are available for a selector valve that switches a direction of pressure oil in a hydraulic circuit. According to the present invention, the slide cushion control device and the die cushion control device can be communalized (commoditized) as a control device.

If slide cushion pressure is set higher than die cushion pressure, timing of turning off the second selector valve 268 (closed state) may be not only a time point before applying die cushion force is started (at time of the crank angle "c" in the present example), but also a time point after applying the die cushion force is started (at the time of the bottom dead center of a crank angle of 180°, for example). In this case, the slide cushion pressure is higher than the die cushion pressure, and thus pressure oil provided for applying die cushion force does not flow to the hydraulic cylinders 120A and 120B from the second selector valve 268 through the piping 192 and the check valve 190.

In the present embodiment, the plurality of the following: the hydraulic cylinders 120A and 120B; the hydraulic cylinders 220A and 220B; the hydraulic circuits 150A and 150B; and the hydraulic circuits 250A and 250B, are individually provided two each, however, the present invention is not limited to the number of the hydraulic cylinders and the like above. In addition, in the present embodiment, although a logic valve of a pilot drive type is used as a pressure control valve for the hydraulic circuits 150A and 150B, besides this, a proportional relief valve may be used, or a proportional flow control valve may be used while controlling its opening, for example, to generate desired slide cushion force.

Although the present embodiment describes a case where oil is used as an operating fluid of the slide cushion device and the die cushion device, besides this, water and another liquid may be used. That is, the embodiment of the present application describes a form of using a hydraulic cylinder, and a hydraulic pump/motor, however, the present invention is not limited to the form. Thus, it is needless to say that a fluid-pressure cylinder and a fluid-pressure pump/motor, using water or another liquid, are available in the present invention. The die cushion-cum-slide cushion device in accordance with the present invention is available for not only a crank press, but also any kind of press machine, primarily a mechanical press.

The present invention is not limited to the embodiments described above, and therefore, it is needless to say that a variety of modifications are possible within a range without departing from the spirit of the present invention.

EXPLANATION OF REFERENCES

1: die cushion-cum-slide cushion device
10: slide
14: crank angle detector
16: crank angular velocity detector
20: upper die
30: bolster
40: lower die
100: slide cushion device
102: upper blank holder
104: upper cushion pin
110: upper cushion pad
120A, 120B, 220A, 220B: hydraulic cylinder
224A, 224B: die cushion position detector
150A, 150B, 250A, 250B, 250A': hydraulic circuit
152: slide cushion pressure generating line
154, 261: accumulator
156: low pressure line
158: logic valve
160: pilot relief valve
164: first solenoid valve
166, 170: throttle valve
172: second solenoid valve
190: check valve
192: piping
262, 362: hydraulic pump/motor
263, 363: servo motor
264, 364: motor angular velocity detector
180, 269: pressure detector
200: die cushion device
202: lower blank holder
204: lower cushion pin
210: lower cushion pad
300: control device
302, 302': die cushion control device
304: slide cushion control device
306: selector
310: die cushion force (pressure) commanding unit
312: die cushion position commanding unit
314, 314': die cushion force (pressure) controller
314*a*: servo motor controller
314*b*: proportional valve controller
316: die cushion position controller
322: slide cushion pressure commanding unit
324: slide cushion force (pressure) controller

What is claimed is:

1. A die cushion-cum-slide cushion device comprising:

an upper cushion pad that supports an upper blank holder through an upper cushion pin;

a first fluid-pressure cylinder that is provided in a slide of a press machine to support the upper cushion pad, and that applies slide cushion force to the upper blank holder when the slide descends;

first piping that is capable of supplying pressure fluid through a check valve to a slide cushion pressure generating line connected to a pressure generating chamber of the first fluid-pressure cylinder;

a fluid-pressure circuit that is connected to the slide cushion pressure generating line, and that includes a pressure control valve that releases pressure fluid pushed out from the pressure generating chamber of the first fluid-pressure cylinder to a low pressure source, the fluid-pressure circuit configured to generate the slide cushion force by controlling fluid pressure in the pressure generating chamber of the first fluid-pressure cylinder;

a lower cushion pad that supports a lower blank holder through a lower cushion pin;

a second fluid-pressure cylinder that supports the lower cushion pad, and that applies die cushion force to the lower blank holder;

second piping that is connected to a pressure generating chamber of the second fluid-pressure cylinder;

a fluid-pressure pump/motor that generates fluid pressure for driving the first fluid-pressure cylinder or the second fluid-pressure cylinder through the first piping or the second piping;

a servo motor that is connected to a rotating shaft of the fluid-pressure pump/motor;

a first selector valve that is connected to the first piping, and that switches opening and closing of a flow channel between the fluid-pressure pump/motor and the first fluid-pressure cylinder; a second selector valve that is connected to the second piping, and that switches opening and closing of a flow channel between the fluid-pressure pump/motor and the second fluid-pressure cylinder;

a valve controller that switches the selector valve so as to open the flow channel between the fluid-pressure pump/motor and the first fluid-pressure cylinder during a first period from a first time point before applying the slide cushion force is started to a second time point at least before applying the die cushion force is started and after the first time point, in one pressing cycle period of the press machine, and that switches the selector valve so as to open the flow channel between the fluid-pressure pump/motor and the second fluid-pressure cylinder during a second period from the second time point to at least a time point when applying the die cushion force is finished;

a slide cushion controller that controls the servo motor to allow the first fluid-pressure cylinder to generate the slide cushion force during the first period from the first time point to the second time point; and a die cushion controller that controls the servo motor to allow the second fluid-pressure cylinder to generate the die cushion force during the second period.

2. The die cushion-cum-slide cushion device according to claim 1, wherein the pressure control valve of the fluid-pressure circuit includes:

a logic valve of a pilot drive type that is provided between the slide cushion pressure generating line and a low pressure line connected to the low pressure source, and that is operable as a main relief valve when the slide cushion force is applied;

a pilot pressure generating line connected to the slide cushion pressure generating line through a throttle valve; and a pilot relief valve that is provided between the pilot pressure generating line and the low pressure line to allow the pilot pressure generating line to generate pilot pressure that controls the logic valve.

3. The die cushion-cum-slide cushion device according to claim 2, wherein the fluid-pressure circuit includes:

a first solenoid valve that switches pressure applying to a pilot port of the logic valve to any one of the pilot pressure and low pressure of the low pressure source, during the one pressing cycle period; and a second solenoid valve that is provided between the slide cushion pressure generating line and the low pressure line to open and close a connection between the slide cushion pressure generating line and the low pressure line.

4. The die cushion-cum-slide cushion device according to claim 3, further comprising:

a controller that controls the first solenoid valve to be able to apply the pilot pressure to the pilot port of the logic valve in a period from before the first time point to when applying the slide cushion force is finished, and that controls the second solenoid valve to close the connection between the slide cushion pressure generating line and the low pressure line in a period from before the first time point to a time point when knocking-out by the upper cushion pad is started.

5. The die cushion-cum-slide cushion device according to claim 4, wherein the controller controls the first solenoid valve to enable low pressure of the low pressure source to be applied to the pilot port of the logic valve when applying the slide cushion force is finished, and controls the second solenoid valve to open the connection between the slide cushion pressure generating line and the low pressure line when the upper cushion pad starts knocking out after elapse of a locking period of the upper cushion pad from a time point when applying the slide cushion force is finished.

6. The die cushion-cum-slide cushion device according to claim 1, further comprising:

a slide cushion force commanding unit that outputs a slide cushion force command; and a slide cushion force detector that detects the slide cushion force generated by the first fluid-pressure cylinder, wherein the slide cushion controller controls torque of the servo motor on the basis of the slide cushion force command and the slide cushion force detected by the slide cushion force detector so that the first fluid-pressure cylinder generates the slide cushion force corresponding to the slide cushion force command.

7. The die cushion-cum-slide cushion device according to claim 1, further comprising:

a die cushion force commanding unit that outputs a die cushion force command; and a die cushion force detector that detects the die cushion force generated by the second fluid-pressure cylinder, wherein the die cushion controller controls torque of the servo motor on the basis of the die cushion force command and the die cushion force detected by the die cushion force detector so that the second fluid-pressure cylinder generates the die cushion force corresponding to the die cushion force command.

8. The die cushion-cum-slide cushion device according to claim 7, further comprising:

a proportional valve that is connected in parallel with the fluid-pressure pump/motor to release a part of pressure fluid, which is pushed out from the pressure generating chamber of the second fluid-pressure cylinder when the die cushion force is applied, to the low pressure source, wherein the die cushion controller controls the torque of the servo motor and opening of the proportional valve on the basis of the die cushion force command and the die cushion force detected by the die cushion force detector so that the second fluid-pressure cylinder generates the die cushion force corresponding to the die cushion force command.

9. The die cushion-cum-slide cushion device according to claim 1, further comprising:

a regenerative unit that regenerates energy expended for allowing the second fluid-pressure cylinder to receive the die cushion force when the die cushion force is applied in the press machine, as electric energy through the fluid-pressure pump/motor and the servo motor.

10. The die cushion-cum-slide cushion device according to claim 1, further comprising:

a die cushion position detector that detects a position of the lower cushion pad, wherein the die cushion controller controls the servo motor by using a die cushion position signal detected by the die cushion position detector, as a position feedback signal for allowing the lower cushion pad to move up and down at a time of knockout operation.

11. A method of controlling the die cushion-cum-slide cushion device according to claim 1, the method comprising the steps of:

switching the selector valve by using the valve controller so as to open the flow channel between the fluid-pressure pump/motor and the first fluid-pressure cylinder during the first period;

switching the selector valve by using the valve controller so as to open the flow channel between the fluid-pressure pump/motor and the second fluid-pressure cylinder during the second period;

generating the slide cushion force with the first fluid-pressure cylinder by allowing the slide cushion controller to control the servo motor during the first period from the first time point to the second time point; and generating the die cushion force with at least the second fluid-pressure cylinder by allowing the die cushion controller to control the servo motor during the second period.

12. The method of controlling the die cushion-cum-slide cushion device according to claim 11, wherein the second period includes a waiting period from the second time point until the slide collides with the lower cushion pad, and a knockout period from after the slide reaches a bottom dead center until reaching a standby position of the lower cushion pad, and wherein the method includes the steps of:

controlling the servo motor by the die cushion controller to keep the lower cushion pad waiting at the standby position during the waiting period; and controlling the servo motor by the die cushion controller to raise the lower cushion pad to the standby position during the knockout period.

* * * * *